US012576892B2

(12) United States Patent
Blum et al.

(10) Patent No.: US 12,576,892 B2
(45) Date of Patent: Mar. 17, 2026

(54) GOODS WAGON FOR TRANSPORTING GOODS AND BASIN FOR SUCH A GOODS WAGON

(71) Applicants: Franz Blum, Salzburg (AT); Peter Blum, Salzburg (AT)

(72) Inventors: Franz Blum, Salzburg (AT); Peter Blum, Salzburg (AT)

( * ) Notice: Subject to any disclaimer, the term of this patent is extended or adjusted under 35 U.S.C. 154(b) by 1335 days.

(21) Appl. No.: 17/438,544

(22) PCT Filed: Mar. 15, 2019

(86) PCT No.: PCT/EP2019/056614
§ 371 (c)(1),
(2) Date: Sep. 13, 2021

(87) PCT Pub. No.: WO2019/175420
PCT Pub. Date: Sep. 19, 2019

(65) Prior Publication Data

US 2022/0144317 A1 May 12, 2022

(30) Foreign Application Priority Data

Mar. 16, 2018 (DE) ..... 10 2018 204 089.3

(51) Int. Cl.
*B61D 3/20* (2006.01)
*B61D 3/18* (2006.01)
*B61D 47/00* (2006.01)

(52) U.S. Cl.
CPC ..... *B61D 3/20* (2013.01); *B61D 3/184* (2013.01); *B61D 47/005* (2013.01)

(58) Field of Classification Search
CPC ..... B61D 3/20; B61D 3/184; B61D 47/005; B65G 3/004
(Continued)

(56) References Cited

U.S. PATENT DOCUMENTS 4,743,150 A 5/1988 Hlinsky
5,511,490 A 4/1996 Fendall et al.
(Continued)

FOREIGN PATENT DOCUMENTS

CN 206406917 U 8/2017
CN 107472265 A 12/2017
(Continued)

OTHER PUBLICATIONS

Machine translation of WO 399 (WO 2016141399) (Year: 2016).*
(Continued)

*Primary Examiner* — Hilary L Gutman
(74) *Attorney, Agent, or Firm* — The Webb Law Firm

(57) ABSTRACT

Provided is a goods wagon for transporting goods, having a head piece at a front end of the goods wagon, an end piece at a rear end of the goods wagon and two side members extending between the head piece and the end piece. A basin for goods is provided, which defines a basin loading surface, and the side members defining a pocket into which the basin is inserted. On the side members fastening elements for the basin are provided, which predefine a loading position in the pocket of the goods wagon for the basin in which the basin loading surface is situated lower than a loading surface provided on the head piece and is situated lower than a loading surface provided on the end piece.

10 Claims, 33 Drawing Sheets

(58) Field of Classification Search
USPC ..... 414/339, 341, 333, 343
See application file for complete search history.

(56) References Cited

U.S. PATENT DOCUMENTS

| | | | | |
|---|---|---|---|---|
| 5,845,356 | A | 12/1998 | Kielinski | |
| 5,890,855 | A | 4/1999 | Claps | |
| 10,583,847 | B2 | 3/2020 | Blum et al. | |
| 11,008,023 | B2 * | 5/2021 | Blum | B61D 3/18 |
| 2003/0017020 | A1 | 1/2003 | Sain | |
| 2006/0099056 | A1 | 5/2006 | Weidemann et al. | |
| 2012/0017799 | A1 * | 1/2012 | Linde | B61D 3/184 414/812 |
| 2014/0133954 | A1 * | 5/2014 | Da Guia Nunes | B61D 3/184 414/812 |
| 2020/0039538 | A1 * | 2/2020 | Blum | B61D 3/00 |
| 2020/0039735 | A1 * | 2/2020 | Blum | B61D 3/18 |

FOREIGN PATENT DOCUMENTS

| | | | | |
|---|---|---|---|---|
| CN | 109177990 | A * | 1/2019 | B61D 17/00 |
| DE | 9102001 | U1 | 6/1991 | |
| DE | 4112995 | A1 | 11/1992 | |
| DE | 4429710 | A1 | 2/1996 | |
| DE | 69404191 | T2 | 1/1998 | |
| DE | 10230110 | A1 | 1/2004 | |
| DE | 20023310 | U1 | 2/2004 | |
| DE | 102006012208 | A1 | 9/2007 | |
| DE | 102009015775 | A1 | 10/2010 | |
| EP | 0572849 | A1 * | 12/1993 | B61D 3/20 |
| EP | 0576852 | A1 | 1/1994 | |
| EP | 0510467 | B1 * | 11/1994 | |
| EP | 0768226 | A2 | 4/1997 | |
| EP | 0619211 | B1 | 7/1997 | |
| EP | 1010600 | B1 | 10/2004 | |
| EP | 1712444 | B1 | 11/2007 | |
| EP | 1582496 | B1 | 4/2010 | |
| EP | 2902299 | B1 | 7/2018 | |
| EP | 3299244 | B1 * | 9/2019 | B61D 3/04 |
| ES | 2611926 | A1 | 5/2017 | |
| FR | 1476665 | A | 4/1967 | |
| FR | 2850929 | A3 | 8/2004 | |
| FR | 2965257 | A1 | 3/2012 | |
| WO | 8102142 | A1 | 8/1981 | |
| WO | 9809889 | A1 | 3/1998 | |
| WO | 0172593 | A1 | 10/2001 | |
| WO | 0198129 | A1 | 12/2001 | |
| WO | 02055359 | A1 | 7/2002 | |
| WO | 03076246 | A1 | 9/2003 | |
| WO | 2007104721 | A1 | 9/2007 | |
| WO | 2011146190 | A2 | 11/2011 | |
| WO | 2016141399 | A1 | 9/2016 | |

OTHER PUBLICATIONS

Machine translation of EP 852 (EP 0576852) (Year: 1994).*
"Autoroute Ferroviaire Alpine (AFA)", Lohr Railway system, 2013, https://www.youtube.com/watch?v=K2SyQ9oDOmc.
Baier, et al., "CargoBeamer—new era in freight traffic", 2011, pp. 240-245.
"CargoBeamer bringt Lkw das Bahnfahren bei", Allianz pro Schiene e.V., 2010, https://www.youtube.com/watch?v=DbSIAvx3kYk.
"ISU-System Be-und Endladung", ISU-System GmbH, 2015, https://www.youtube.com/watch?v=1VsbTdWYF6o.
"Training video Sdggmrs T", Cargolink CI, 2014, https://www.youtube.com/watch?v=cQoVlej_R-8.

* cited by examiner

GOODS WAGON FOR TRANSPORTING GOODS AND BASIN FOR SUCH A GOODS WAGON

CROSS-REFERENCE TO RELATED APPLICATIONS

This application is the United States national phase of International Application No. PCT/EP2019/056614 filed Mar. 15, 2019, and claims priority to German Patent Application No. 10 2018 204 089.3 filed Mar. 16, 2018, the disclosures of which are hereby incorporated by reference in their entirety.

BACKGROUND OF THE INVENTION

Field of the Invention

The disclosure relates to a goods wagon for transporting goods and to a basin for such a goods wagon.

Description of Related Art

Rail-bound goods wagons for transporting cranable or non-cranable goods, in particular so-called pocket wagons, are widely known. Such goods wagons are usually equipped and provided for transporting containerized goods and for transporting semi-trailers. In particular for transporting semi-trailers, (insert) basins are often used in practice which, together with a semi-trailer arranged and fixed thereon, are inserted into a pocket of the goods wagon. This pocket is defined by side members of the goods wagon which extend between a head piece at a front end of the goods wagon and an end piece at a rear end of the goods wagon. In the pocket of the goods wagon defined by the two side members located opposite one another a support structure for the basin to be inserted is usually formed. This support structure is formed for example by cross-members interconnecting the two side members and/or at least one additional longitudinal brace running centrally on the goods wagon in order to be able to position and support the basin on the goods wagon as intended.

Such goods wagons are known for example from DE 41 12 995 A1, EP 1 712 444 B1 and EP 0 619 211 B1.

The goods wagons developed and employed in practice to date with an insertable basin for goods are regularly comparatively inflexible and/or only conditionally utilizable economically, since a container transport with such goods wagons is usually possible only to a limited extent or only in that the basin remains at a loading station. However, in the case of the basin remaining at the loading station, additional parking space must then be reserved at the loading station for an indefinite period of time, since any other utilization or transport of the basin without the associated goods wagon is not possible.

Goods wagon sub-loading systems have therefore been proposed in recent times which make it possible for a semi-trailer combination with the goods to be transported to directly drive up onto a goods wagon. Such a system with suitably designed goods wagons is offered for example by Cargobeamer AG. There, each goods wagon comprises a basin that can be pushed out laterally, into which a semi-trailer tractor can drive. However, the goods wagons to be used in this system are technically complex and comparatively expensive. The same applies to the special loading/unloading systems of a Cargobeamer loading station to be provided.

SUMMARY OF THE INVENTION

Thus there is a need for possibilities to further flexibilize and configure more cost effectively the rail-bound transporting of goods and facilitate the loading process of goods onto rails.

Against this background a goods wagon having features as described herein and a basin having features as described herein are proposed.

According to a first aspect of the proposed solution, a goods wagon for transporting goods is provided, in the case of which on the two side members located opposite one another and each connecting a head piece and an end piece of the goods wagon with one another, fastening elements for a basin defining a basin loading surface are provided, which predefine a loading position in the pocket of the goods wagon for the basin, in which the basin loading surface is situated lower than a (first) loading surface provided on the head piece and is situated lower than a (second) loading surface provided on the end piece. In addition, the goods wagon for transporting containerized goods is equipped and provided independently of the basin in that a transport position is predefined on the goods wagon for the containerized goods, in which the containerized goods, with the basin present in the loading position, extend above the basin loading surface over at least one part of the basin loading surface.

With a goods wagon according to the first aspect of the proposed solution, the basin positioned in the pocket of the goods wagon in its loading position can thus be carried along with the goods wagon while containerized goods can be transported with the goods wagon at the same time without said containerized goods having to be supported on the basin loading surface of the basin. On the contrary, the goods wagon with its fastening elements is equipped to transport containerized goods without said goods resting on the basin loading surface. At the same time, a loading position is predefined on the goods wagon for the basin in which the basin does not restrict the loading and unloading of containerized goods and in which the containerized goods can be easily positioned and fixed on the goods wagon above the basin loading surface as intended. Transporting containers and transporting semi-trailers is thus possible independently of one another and thus optionally possible with such a goods wagon without the basin having to be removed from the goods wagon when at least one container is to be transported therewith. It is thus possible with the goods wagon to transport at least one container from a first loading station to a second loading station in or above the pocket, into which the basin is inserted, and then load a semi-trailer at the second loading station by means of the basin and transport the same to a third loading station after the at least one container has been unloaded at the second loading station. In an embodiment version, the goods wagon is equipped for example for transporting a 45 foot container which is supported on the loading surface of the head piece and the loading surface of the end piece and extends in the region of the side members over the basin loading surface of the basin inserted into the pocket.

According to a second aspect of the proposed solution, which is independent of the first aspect explained above, but easily combinable therewith, additional fastening elements are provided on the side members which predefine a function position on the pocket of the goods wagon for the basin, in which the basin loading surface is situated at least at the height of the loading surface of the head piece, in order to define with the loading surface of the head piece a continuous wagon loading surface.

In addition to fastening elements for predefining the loading position in the pocket, in which the basin surface is situated lower than a loading surface of the head piece, additional fastening elements are thus provided in this version on the side members of the goods wagon for predefining an additional function position on the pocket. By way of the possibility of fixing the basin on the side members in two different positions, the loading position on the one hand and the function position on the other hand, different loading and transporting scenarios can be covered with the goods wagon. When for example the basin present in the loading position and for example inserted on the goods wagon by means of a crane makes possible the loading and transporting of a semi-trailer fixed on the basin loading surface, a driving-up of a complete semi-trailer combination or at least a truck tractor (without semi-trailer) onto the goods wagon by way of the roll-on method can be made possible by way of a continuous wagon loading surface of head piece-side loading surface and basin loading surface defined with the basin present in the function position.

In an embodiment version according to the first or second aspect, at least one connecting element formed with a connecting opening is provided for the connection with a fastening element, which via this connecting opening is fixed on a fastening element in a positive-locking manner when the basin is present in its loading position. The positive-locking connection between fastening element and inserted basin on a connecting element of the basin designed for this purpose can facilitate on the one hand an intended positioning of the basin, but on the other hand also ensure a secure locking of the inserted basin on the side members.

Alternatively or complementarily, the basin in the loading position can be mounted on the fastening elements of the side members. A mounting of the basin can be achieved for example by way of at least one connecting element of the basin forming a connecting opening. For example, at least one connecting element protruding tab-like is provided on the basin which is mounted on a for example stud-shaped fastening element of the goods wagon protruding toward the inside in the direction of the side member located opposite when the basin is in the loading position. Thus, the basin can be easily inserted into the pocket from above and mounted on the fastening elements of the side members.

In particular in the embodiment version explained above it can be provided that the pocket of the goods wagon is designed as a continuous recess, i.e. without cross-members connecting the two side members between head piece and end piece with one another and without an additional longitudinal brace connecting the head piece and the end piece with one another and running within the pocket. Thus, in such an embodiment version, no supporting structure for supporting the inserted basin is present on the goods wagon apart from the side member. In particular, the basin situated in the loading position and if applicable mounted on the side members is not supported on a support structure connecting the two side members. In this way, the goods wagon can be comparatively light-weight in construction and employed in a highly flexible manner.

In an exemplary embodiment, fastening elements are provided on the side members, which predefine a transport position on the goods wagon for the containerized goods, in which the containerized goods, with the basin present in the loading position, extend above the basin loading surface over at least one part of the basin loading surface. On the side members, fastening elements for example in the form of locating studs are thus provided here which make possible an intended positioning and fixing of containerized goods on the goods wagon, but in the process hold the containerized goods above the basin loading surface. In this manner, the basin situated in the loading position need not be designed for the container transport—insofar as in accordance with the first aspect of the proposed solution—and can be easily taken along on the goods wagon when transporting the container.

By way of the fastening elements at least two different transport positions are predefined for containerized goods in a possible further development, in which the containerized goods each extend above the basin loading surface over at least one part of the basin loading surface. In this embodiment version, fastening elements for at least two different types of ISO containers can thus be present for example on the side members of the goods wagon, wherein by way of the fastening elements a first transport position is predefined for a first type of container, which deviates from a second transport position, which is predefined by way of the same or other fastening elements on the side members for another second type of container. For example, fastening elements for different types of containers can be provided on the side members at different heights. For example, first fastening elements for a first type of container are provided nearer to an upper edge of each side member while fastening elements for another type of container are provided lying lower on the side members and within the pocket. For example, different and differently positioned fastening elements for positioning 20 foot, 40 foot and 45 foot containers are provided on the side members.

Basically, at least one of the fastening elements for containerized goods can be adjustably mounted alongside a side member and/or be completely removable from the side member. An adjustable fastening element thus makes possible predefining different fastening points alongside a side member, in that the fastening element can be adjusted, in particular moved alongside the side member. Alternatively or complementarily, a variable predefining of a fastening point is likewise possible by way of a fastening element that is completely removable from the side member. A completely removable fastening element can be detachably connected for example to the respective side member in order to be able to remove the fastening element from the respective side member when required. Here, the position of individual fastening points can depend for example on the size of the container to be transported. Both an adjustable and also a completely removable fastening element can additionally have the advantage here that the respective fastening element can be positioned on or in the pocket of the goods wagon only when required for holding and fastening containerized goods.

In an embodiment version, at least one of the fastening elements for containerized goods is pivotably mounted on the side member. In this manner, the at least one fastening element is adjustable about a defined pivot axis predefined by the design. For example, the at least one fastening element pivotably mounted on the side member is pivotable between a non-usage position and a usage position, wherein the fastening element in its non-usage position is present outside the pocket and in its usage position is present within the pocket. In its non-usage position such a fastening element is thus pivoted out of the pocket and thereby frees the pocket for a loading and unloading of goods with or without basin.

At least one of the fastening elements provided on the side members for predefining a transport position for containerized goods can, in an embodiment version, also predefine the function position for the basin on the pocket of the goods wagon, in which the basin loading surface of the basin is situated at least at the height of the loading surface of the head piece (if applicable, also at the height of the loading surface of the end piece of the goods wagon) in order to define with the loading surface of the head piece (and if applicable, the loading surface of the end piece) a continuous wagon loading surface. Thus, such a fastening element then fulfils a dual function on the goods wagon. On the one hand, such a fastening element is equipped and provided for the intended holding and fixing of containerized goods on or in the pocket. On the other hand, the same fastening element is also equipped and provided to hold the basin in a function position predefined in addition to the loading position. Such a further developed goods wagon thus makes possible, by way of a comparatively small number of fastening elements and the goods wagon equipped with a basin, an additional flexibilization in the rail-bound transporting of widely differing goods.

In an embodiment version, optionally at least one 20 foot container, at least one 40 foot container, at least one 45 foot container, at least one semi-trailer and/or at least two truck tractors are transportable by means of the goods wagon equipped with the basin. In a further development, transporting all abovementioned goods is optionally possible via a combination of different fastening elements and the basin fastened to the side members. Thus, one and the same goods wagon can (with basin held on the side members) optionally transport either at least one 20 foot container or at least one 40 foot container or at least one 45 foot container or at least one semi-trailer or at least two truck tractors.

According to a further, third aspect of the proposed solution, which is independent of the previously mentioned first and second aspects, but is easily combinable with these, a basin for a goods wagon for transporting (cranable or non-cranable) goods is proposed, in which the basin includes a ramp assembly with at least one ramp for driving a truck tractor into the basin and in which two different ramp positions are predefined for the ramp assembly on the basin.

By way of the at least one ramp a truck tractor can drive into the basin in order to park off a semi-trailer on a basin loading surface (which is continuous or only present in sections) of the basin. For this purpose, the basin is then placed on a ground for example in a loading station and is subsequently positioned with the semi-trailer in a pocket of the goods wagon. Such a ramp is usually a separate component which is stored independently of the respective basin at a loading station, thus at a terminal. In practice, the ramp is then positioned according to the track width of the truck tractor and if applicable fixed to the basin placed on the ground. Following the parking off of the semi-trailer in the basin, the ramp is removed again. Handling and transporting such ramps usually render the loading/unloading operations more difficult.

In that on a proposed basin for the ramp assembly at least two different ramp positions are now already predefined, of which a first ramp position is provided for transporting a semi-trailer in the basin and a second ramp position is provided for transporting a truck tractor in the basin, handling and transporting the at least one ramp of the ramp assembly are substantially simplified. Depending on whether a semi-trailer or a truck tractor are to be transported and loaded onto a goods wagon by means of the basin, the ramp assembly is either arranged in the one (first) or the other (second) predefined ramp position on the basin.

In this connection it is obviously possible to use such a basin with ramp assembly in a goods wagon according to the embodiment versions of the first and/or second aspect of the proposed solution discussed above. In particular, the ramp assembly in this case can also be positioned and fixed on the basin as intended when the basin is present in a loading position in the pocket of the goods wagon, but containerized goods, not goods held on the basin, are transported by means of the goods wagon.

Independently of this it is provided in an embodiment version that the at least one ramp of the ramp assembly in the first ramp position is present in a position on the basin which compared with a position of the at least one ramp in the second ramp position is offset transversely and/or parallel with respect to an extension direction of the ramp. In the first ramp position, the ramp, for example compared with a position for transporting a truck tractor, is thus presently offset transversely and/or parallel with respect to a driving-in direction of the truck tractor. Here, a transverse offset can be provided for example for different track widths. A parallel offset can also be due for example for utilizing the at least one ramp as transportation surface on which the truck tractor at least partially stands even after the loading of the basin on the goods wagon. Accordingly, a ramp that is offset parallel in the second ramp position (relative to the first ramp position) can protrude further over a front-side edge of the basin than in the first ramp position and thus provide a transportation surface for a truck tractor that is extended beyond the edge of the basin.

In an embodiment version, the at least one ramp is pivotably mounted on the basin at least in the second ramp position provided for transporting a truck tractor. Accordingly, the ramp can then pivot upwards during the insertion of the basin into the pocket of the goods wagon in order to hold and transport a truck tractor positioned on the basin and standing on the at least one ramp in a tilted position on the goods wagon.

Alternatively or complementarily, the ramp assembly can include at least one ramp pair and at least one ramp extension. Here, the at least one ramp extension can be arranged as intended in the first ramp position provided for transporting a semi-trailer between the two ramps of the ramp pair, while the at least one ramp extension in the second ramp position provided for transporting a truck tractor can be connected or is connected to one of the ramps of the ramp pair in order to extend the respective ramp. In the first ramp position, the ramp extension can be present compactly stowed on the basin. When required, the ramp extension can be connected to one of the ramps in the second ramp position in order to utilize for example the driving-in or the transporting of the truck tractor. With few intercombinable components of a ramp assembly, a comparatively simple adaptability to different loading scenarios is thus possible on a basin without different basins or ramp assemblies having to be provided for this purpose.

Basically, the at least one ramp extension can be detachably fixed on at least one ramp of the ramp pair in the first ramp position. Thus, the ramp extension is secured on the basin in the first ramp position provided for transporting a semi-trailer. The fixing however can be released if required and thus the ramp extension rendered utilizable in the second ramp position. For example, the fixing of the ramp extension is performed by means of at least one fixing element, for example in the form of a fixing bolt or fixing pin which extends transversely to an extension direction of the ramp.

In a possible further development, the ramp assembly includes two ramp pairs and/or two ramp extensions. By way of two ramp pairs and different ramp positions on the basin predefined for this purpose, the driving-in of a semi-trailer into the basin from different directions is facilitated without the respective ramps having to be relocated from one end of the basin to the other end of the basin or the basin having to be arranged turned by 180°. By way of this, transporting two truck tractors on a basin can also be facilitated in that a guided driving-in of the truck tractors from driving-in directions that are opposite to one another is possible by means of both ramp pairs. In such a manner, the truck tractors with their cabs facing one another can each stand with their rear wheels on the ramps of a ramp pair that protrudes over a basin loading surface of the basin on both sides of the basin.

BRIEF DESCRIPTION OF THE DRAWINGS

The attached figures illustrate exemplarily possible embodiment versions of the proposed solution.

DESCRIPTION OF THE INVENTION

Figure 1:
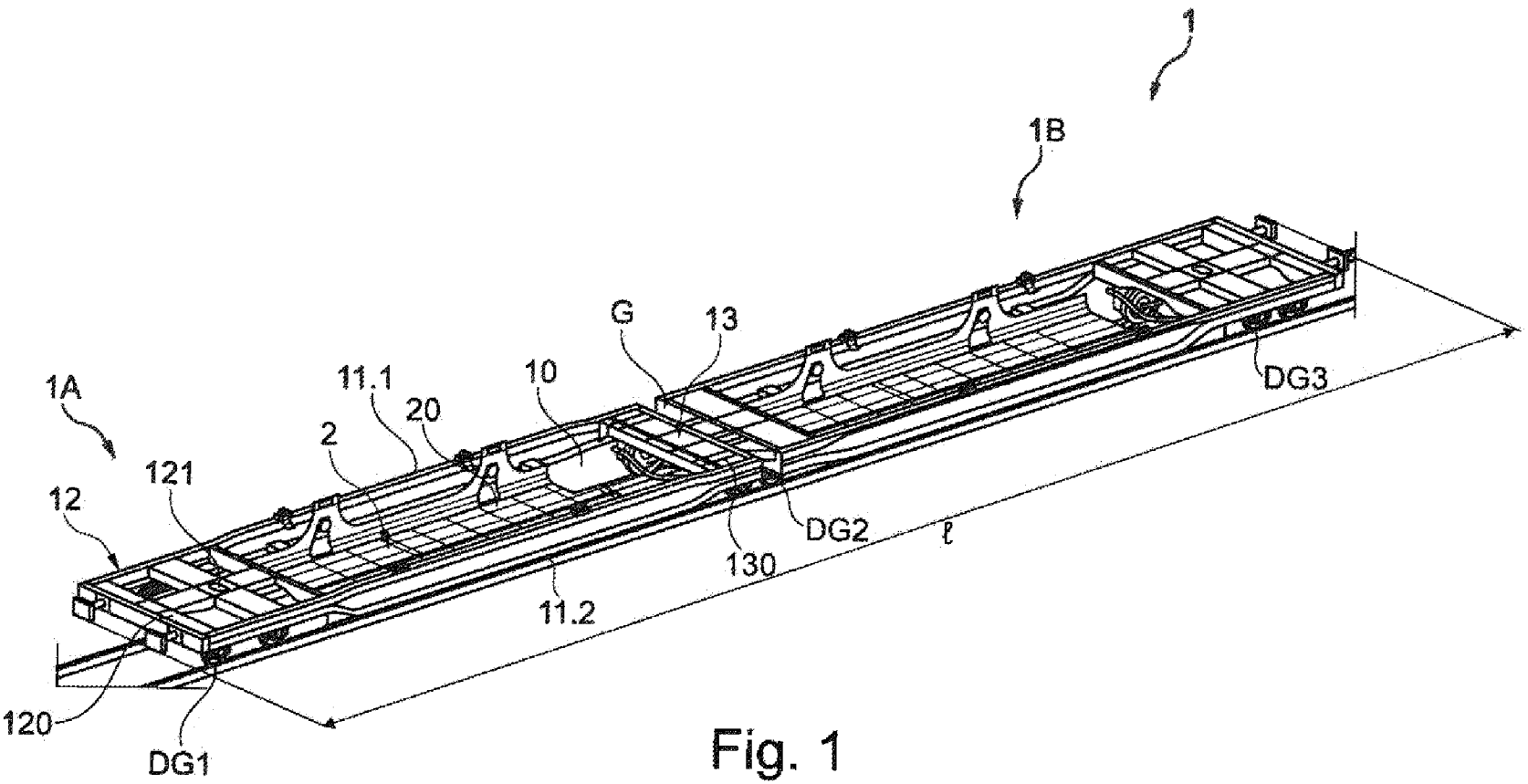
FIG. 1 shows a goods wagon embodied as double pocket wagon according to the proposed solution in a perspective view.
Figures 2, 2A, 2B:
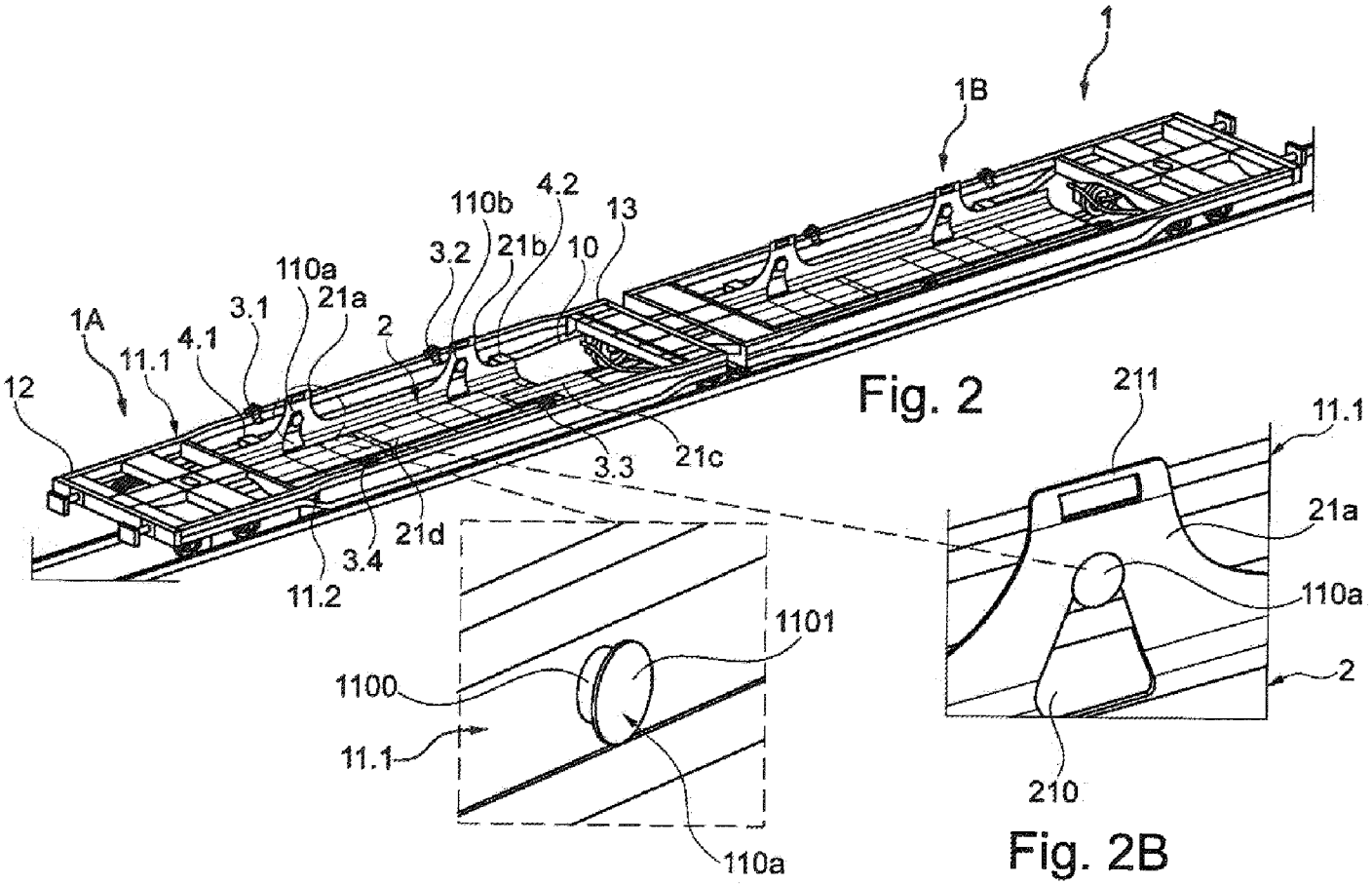
FIG. 2 shows the double pocket wagon of FIG. 1 with different fastening elements highlighted on the pockets of the double pocket wagon for fixing a mounted basin.
FIGS. 2A-2B show enlarged views of the regions highlighted in FIG. 2 without and with basin.
Figure 3:
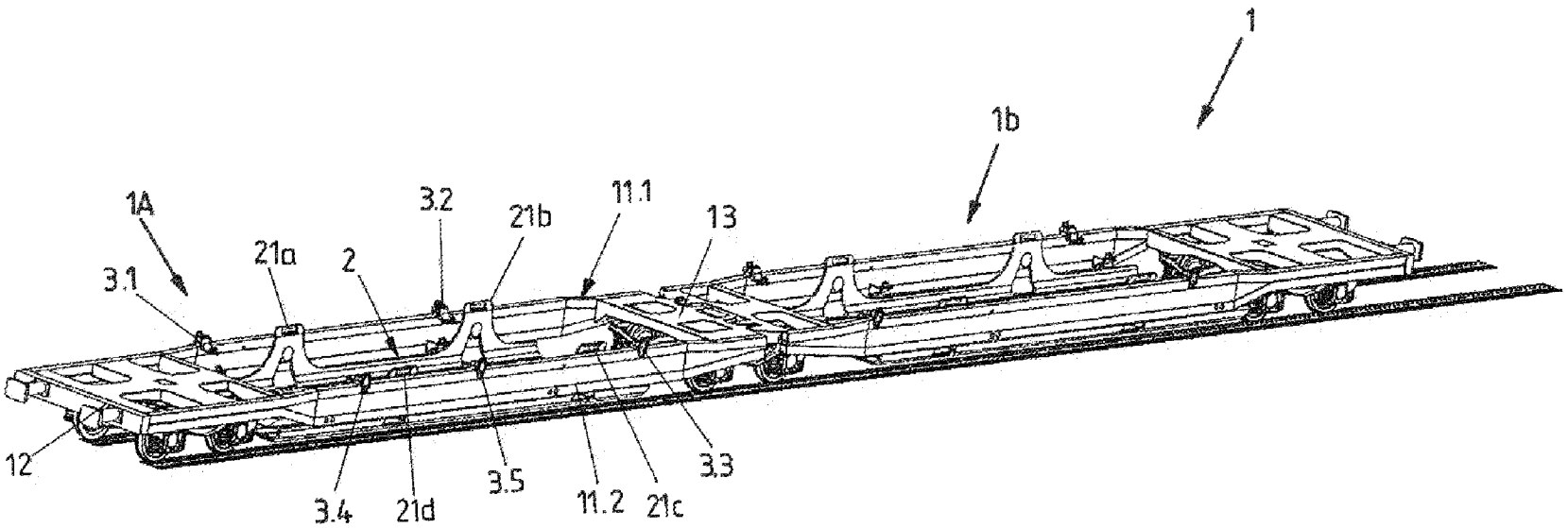
FIG. 3 shows a further perspective view of the double pocket wagon of FIG. 1.
Figure 4:
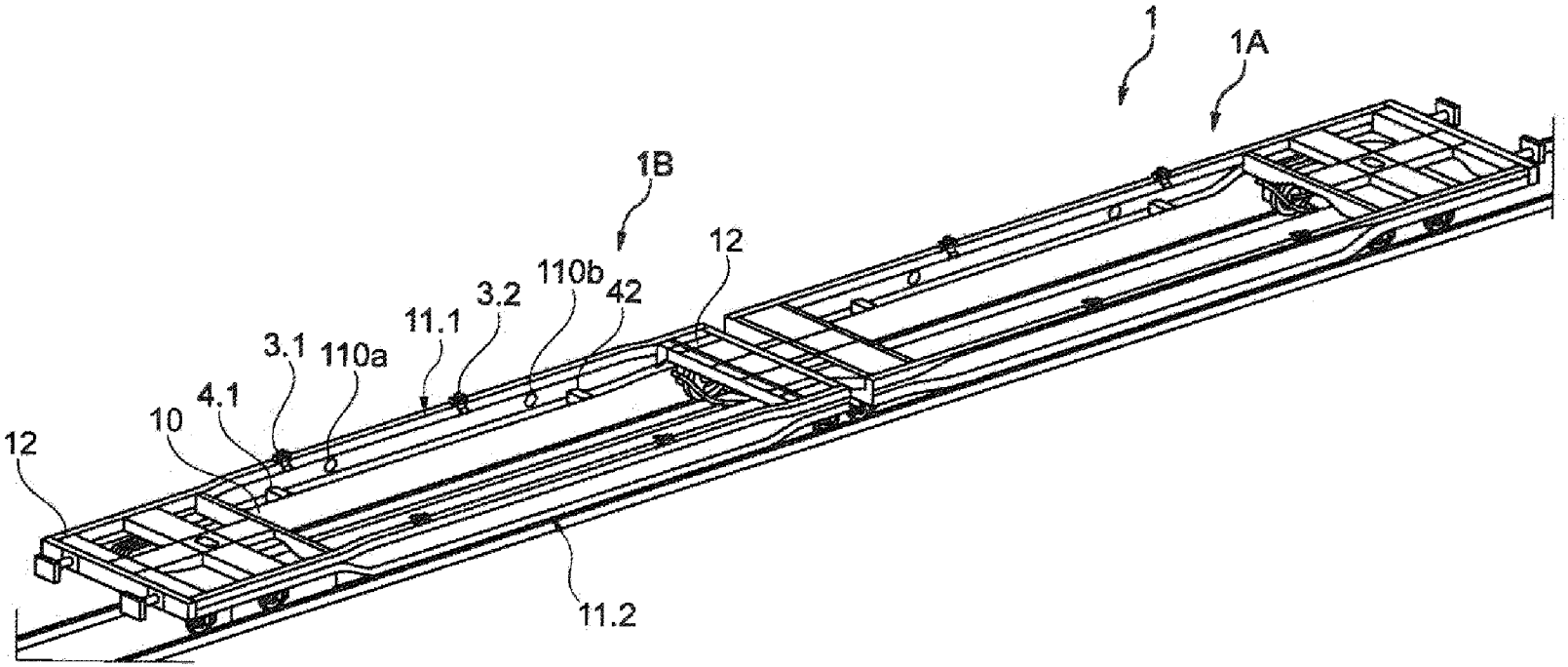
FIG. 4 shows in a view corresponding to FIG. 1 the double pocket wagon without basin mounted thereon.
Figures 5, 5A, 5B:
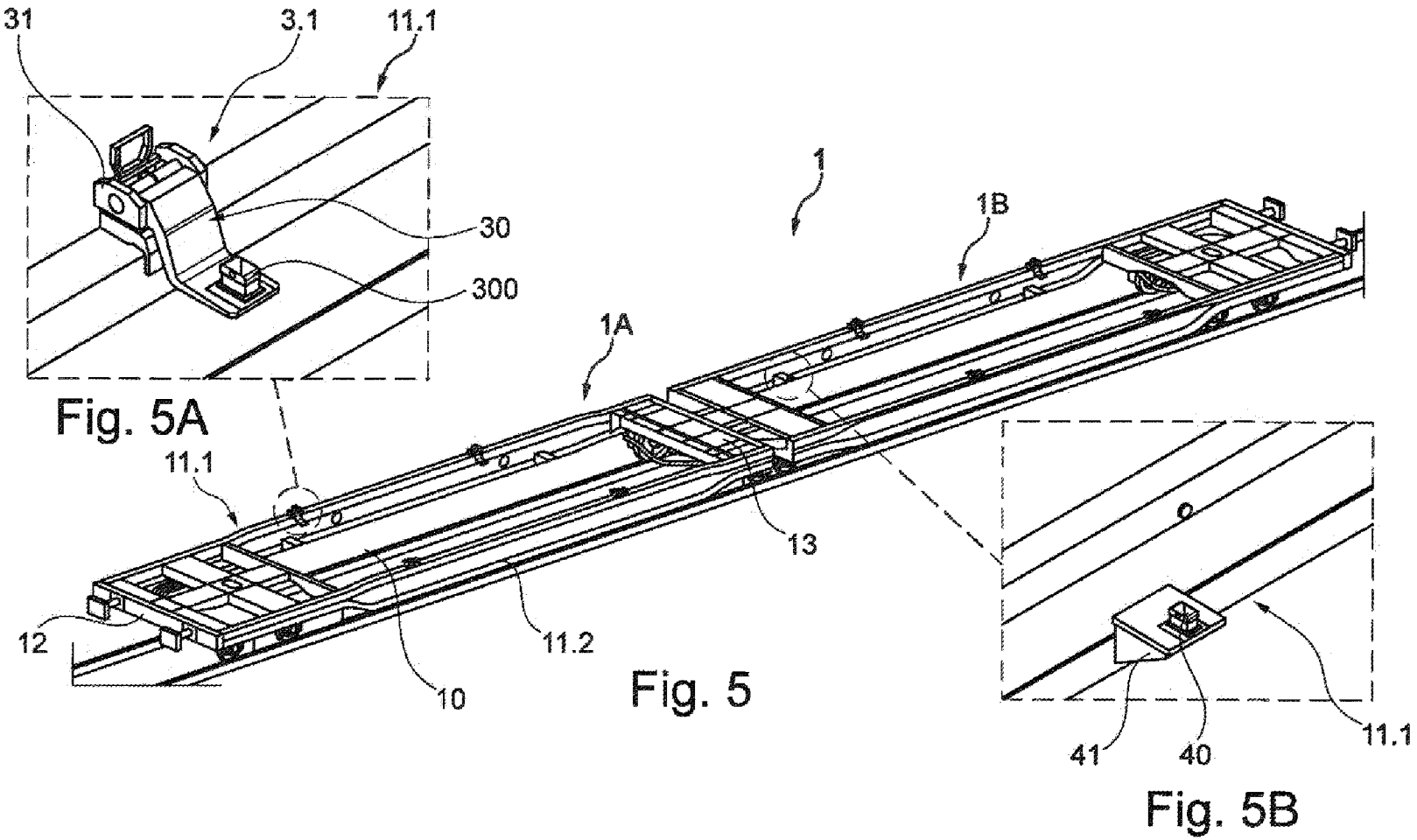
FIG. 5 shows the double pocket wagon of FIG. 4 with highlighted fastening elements provided on the double pocket wagon for containerized goods of different size.
FIGS. 5A-5B show enlarged representations of the regions highlighted in FIG. 5.
Figure 6A:
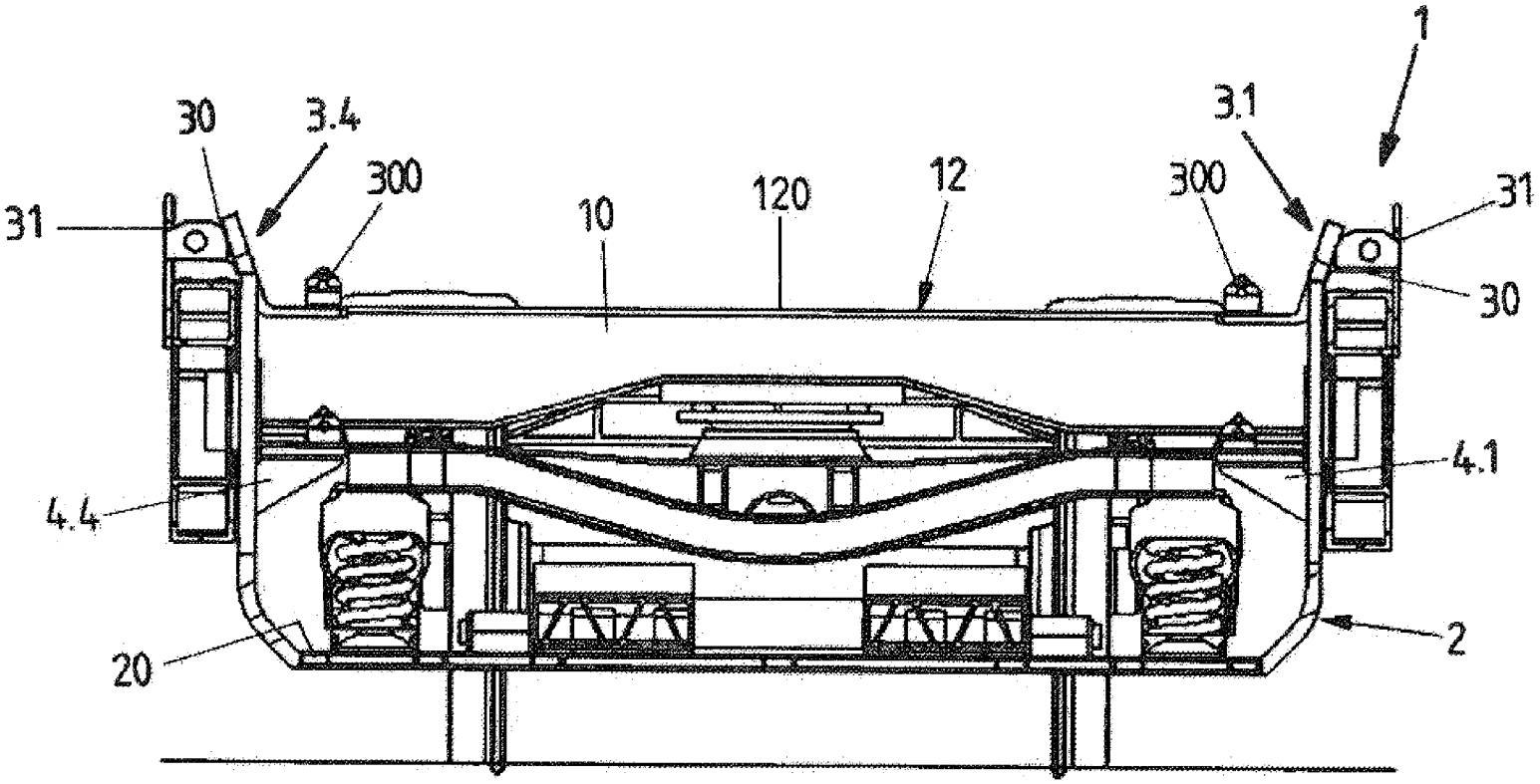
FIGS. 6A-6B show cross-sectional views of the double pocket wagon with fastening elements for containerized goods in two different adjusting positions.
Figure 6B:
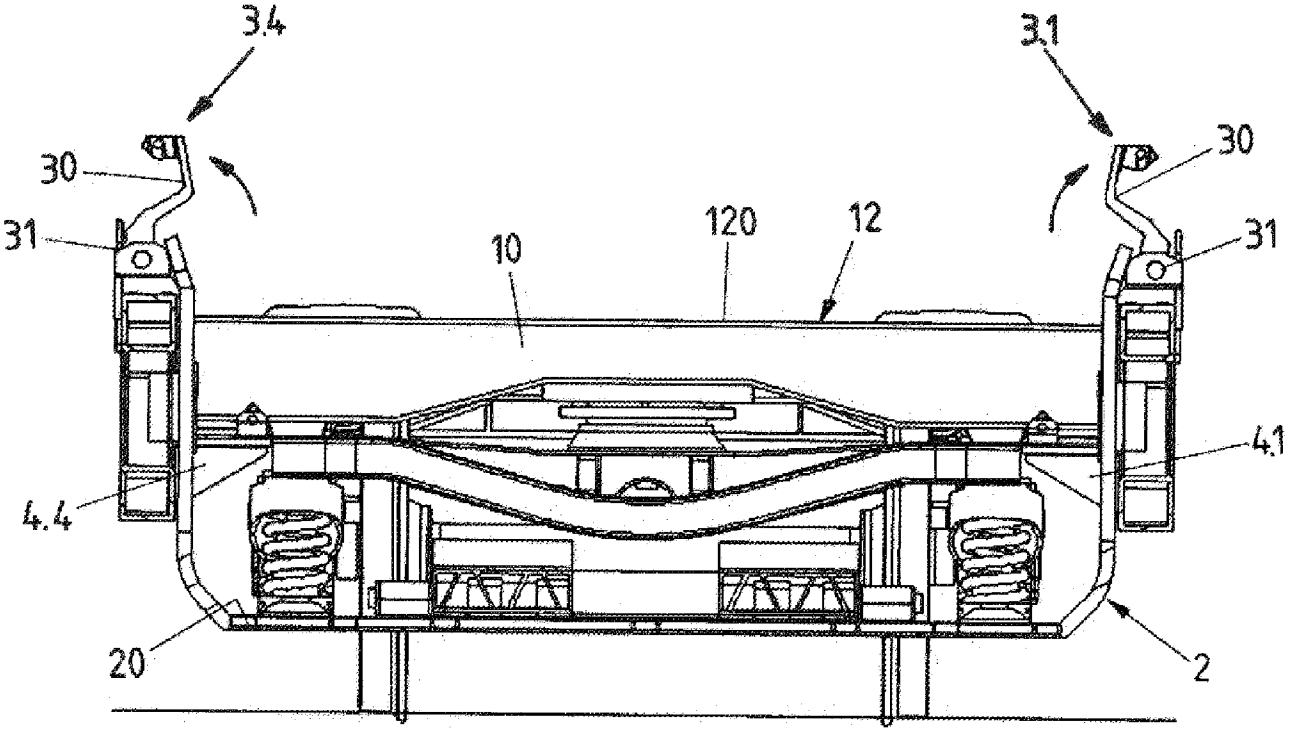
Figure 7B:
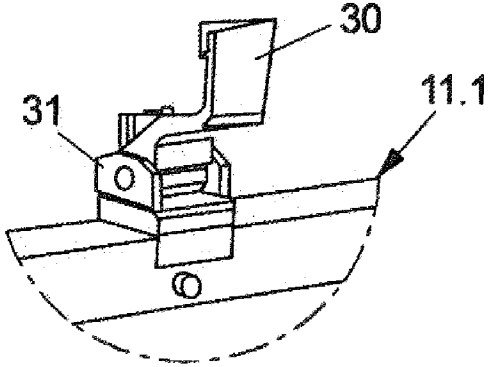
FIGS. 7A-7B show enlarged representations of the fastening elements for containerized goods present in the different adjusting positions.
Figure 7A:
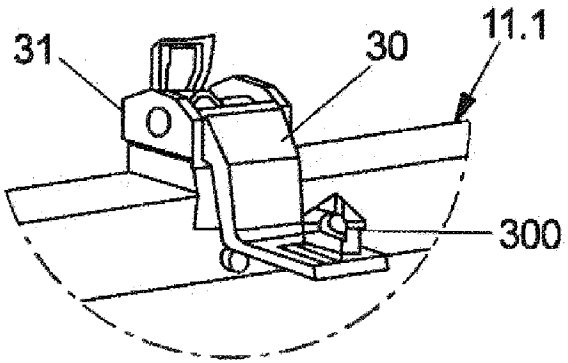
Figure 8A:
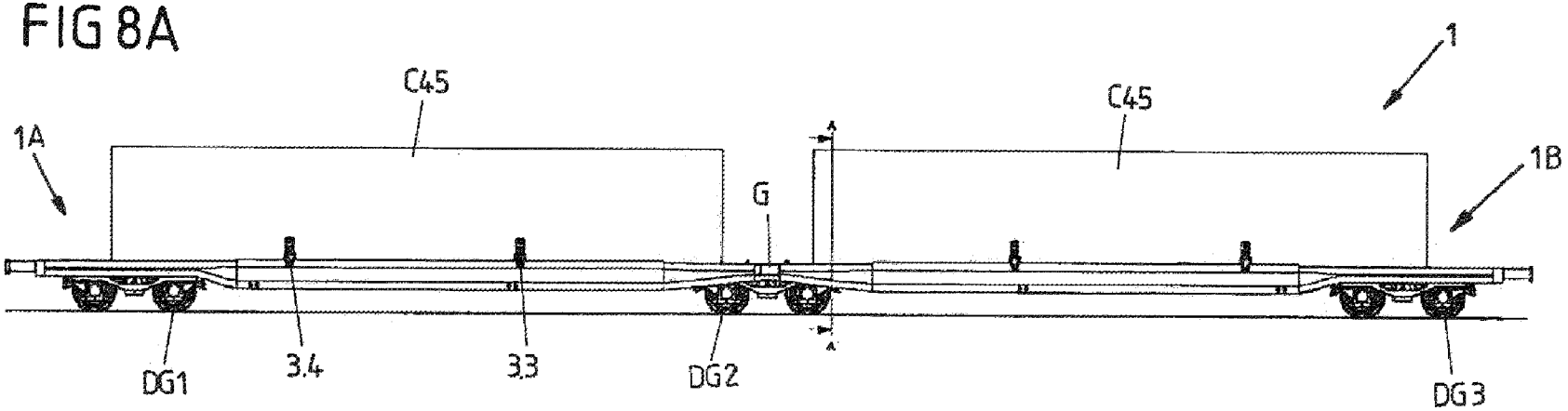
FIGS. 8A-8D show the double pocket wagon of FIG. 1 with loaded 45 foot container in different views and without basins mounted in the pockets of the double pocket wagon.
Figure 8B:
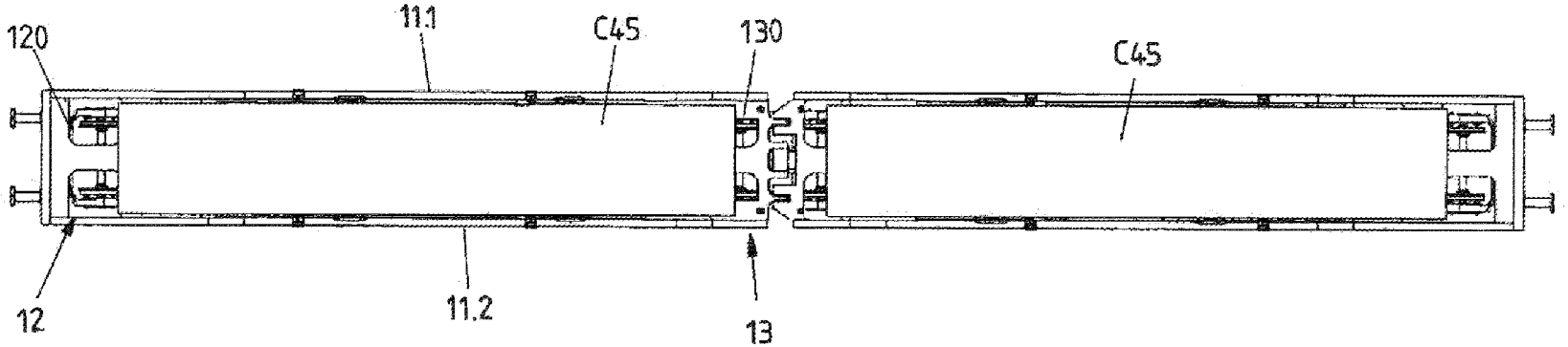
Figure 8C:
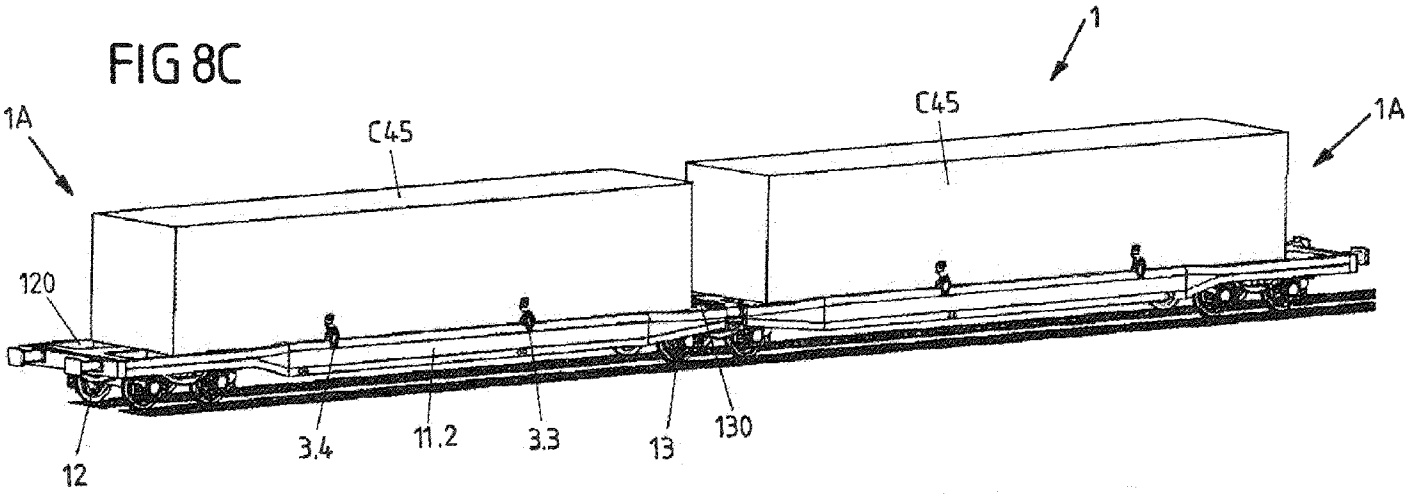
Figure 8D:
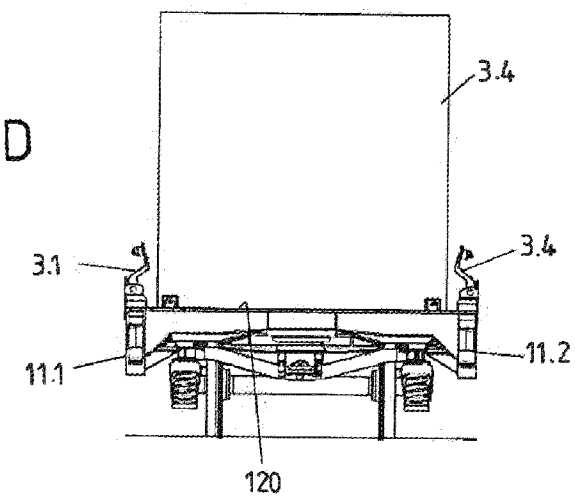

The attached FIGS. 1 to 27 show in different views and configurations a goods wagon designed as double pocket wagon 1, which is characterized by a particular flexibility in terms of the transportability of a wide range of goods. With the double pocket wagon 1 of the FIGS. 1 to 27, both cranable goods and also non-cranable goods, in particular semi-trailers, truck tractors and ISO containers of different sizes can be transported. The double pocket wagon 1 designed for the inter-modal goods traffic offers here a maximum of flexibility with respect to the goods to be transported and loaded.

As is shown in particular when viewing FIGS. 1 to 7B together, the double pocket wagon 1 comprises two pocket wagons 1A and 1B that are coupled to one another in an articulated manner. Here, the pocket wagons are basically configured identically so that in the following features explained for one of the pocket wagons 1A or 1B also apply to the other pocket wagon 1B or 1A.

The double pocket wagon 1 has an overall length 1 of approximately 34 m and corresponds to the requirements of the structure gauge G1 for the international goods traffic. The double pocket wagon 1 includes for the rail-bound transport three bogies DG1, DG2 and DG3. A bogie DG1 or DG3 is respectively provided here at a head piece 12 of a pocket wagon 1A or 1B, while the one bogie DG2 is provided centrally on the double pocket wagon 1 in the region of an articulated connection G of the two pocket wagons 1A and 1B. In the region of the articulated connection G, the two pocket wagons 1A and 1B are each coupled to one another via an end piece 13.

A head piece 12 as well as an end piece 13 of a pocket wagon 1A or 1B each forms a wagon-side loading surface 120 or 130 on the shown double pocket wagon 1. In the region of a first loading surface 120 of the head piece 12, a respective pin hitch 121 for a kingpin of a semi-trailer is provided. Between a head piece 12 and an end piece 13 there extend two side members 11.1 and 11.2 each located opposite one another, via which a head piece 12 and end piece 13 are connected to one another. Between the side members 11.1 and 11.2 a pocket 10 with a length of at least 9 m, in particular of at least 10 m is defined. This pocket 10 is circumferentially bordered here merely by the two side members 11.1 and 11.2 as well as the head piece 12 and the end piece 13 of a pocket wagon 1A or 1B. Thus, there is no further support structure connecting the two side members 11.1 and 11.2 or the head piece 12 and the end piece 13 provided between the side members 11.1 and 11.2. Thus, the pocket 10 is merely designed as a continuous recess without additional stiffening support structures running transversely or longitudinally and bounded on the circumference side by a frame-like structure of head piece 12, the two side members 11.1 and 11.2 and end piece 13.

In each pocket 10 of a pocket wagon 1A or 1B of the shown double pocket wagon 1 a removable (insert) basin 2 is placed. Here, a basin 2 is mounted on the two side members 11.1 and 11.2 located opposite one another by fastening elements formed as mounting studs 110*a* and 110*b*. As is illustrated for example in particular in the FIGS. 1, 2, 2A to 2B and 3, a basin 2 comprises a flat basin loading surface 20, on which for example a semi-trailer or a truck tractor can be positioned. At lateral edges of this basin loading surface 20, the basin 2 forms connecting elements in the form of four mounting tabs 21*a* to 21*d*. Each two mounting tabs 21*a*/21*b*, or 21*c*/21*d* formed on a longitudinal side of the basin 2 are equipped and provided for being mounted here on one of the side members 11.1, 11.2.

Here, each individual mounting tab 21*a* to 21*d* forms a connecting opening 210, in which on mounting the basin 2, for example by means of a reach stacker or a portal crane, a mounting stud 110*a* or 110*b* formed on the side member 11.1 or 11.2 can engage in a positive locking manner. As is evident for example in the enlarged representations of the FIGS. 2A and 2B, each mounting stud 110*a* or 110*b* for this purpose forms a cylindrical body 1100 projecting on the respective side member 11.1, 11.2 toward the inside with an end-side head 1101. A mounting tab 21*a* to 21*d* of the basin 2 is mounted via its connecting opening 210 on the body 1100 of the mounting stud 110*a* or 110*b* so that an upper edge of the respective mounting tab 21*a* to 21*d* is present between an inner side of the respective side member 11.1 and 11.2 and the head 1101 of the associated mounting stud 110*a* or 110*b* when the basin 2 is inserted in a pocket 10 as intended.

For loading the basin 2 and in particular the inserting into a pocket 10 of the same or the removal of a basin 2 from the pocket 10, transport bars 211 with through-openings are formed at an upper end of each mounting tab 21*a* to 21*d*. A usual loading/unloading system for example a reach stacker or portal crane can engage for example in the through-openings of the transport bars 211 in order to remove a basin 2 from the respective pocket 10 or mount it in the pocket 2.

When the basin 2 is mounted on the side members 11.1 and 11.2 of the double pocket wagon 1 as intended, the basin loading surface of the basin 2 is situated lower than the loading surfaces 120 and 130 of the head piece 12 and of the end piece 13. This circumstance is utilized here to make possible transporting containerized goods without having to utilize the basin 2 for this purpose. Thus, containerized goods can be transported with the double pocket wagon 1 of the FIGS. 1 to 27 independently of the basin 2. Consequently, the basin 2, mounted on the side members 11.1 and 11.2, can remain in the respective pocket 10 even when no goods are transported with the basin 2.

Accordingly, each pocket wagon 1A, 1B of the double pocket wagon comprises additional fastening elements in the form of locating studs 300, 40 in the region of a pocket 10, on which ISO containers of different type and size can be fixed as intended without the basin 2 having to be removed or positioned in the pocket 10 for this purpose. Here, multiple different locating studs 300 and 40 are provided on each pocket wagon 1A or 1B in the region of the side members 11.1 and 11.2 in order to be able on the one hand to transport containerized goods of different size on and in the pocket 10.

As is illustrated in more detail in particular by way of the FIGS. 4, 5, 5A to 5B, 6A to 6B and 7A to 7B, multiple, here at least two pairs of different locating studs 300, 40 are provided on each side member 11.1 and 11.2. At an upper edge of each side member 11.1 and 11.2 for example at least two (upper) locating stud units 3.1, 3.2 or 3.3, 3.4 are provided. Each of these locating stud units 3.1 to 3.4 engages an upper edge of the respective side member 11.1 or 11.2 with a bearing block 31. Here, a respective pivot bearing part 30 is pivotably mounted on this bearing block 31. On the pivot bearing part 30 the locating stud 300 is again formed which is thus pivotable via the pivot bearing part 30 between a non-usage position according to the FIGS. 6B and 7B and a usage position according to the FIGS. 5A, 6A and 7A on the side member 11.1 or 11.2. In a usage position, the pivot bearing part 30 with the locating stud 300 projects into the pocket 10 so that a container can be fixed thereon. In the non-usage position, the locating stud 300 by contrast is pivoted out of the pocket 10 toward the outside. In the non-usage position, a container can thus be arranged on the double pocket wagon 1 without fixing on the locating stud units 3.1 to 3.4 (see for example FIGS. 8A to 9B) and if applicable can also be inserted, past the locating stud units 3.1 to 3.4, in the interior of the pocket 10 (see for example FIGS. 11A to 11B).

The locating stud units 3.1 to 3.4 can basically be positioned fixed on the side members 11.1 and 11.2. In the shown embodiment version, the locating stud units 3.1 to 3.4 can be freely positioned, in particular rolled along a side member 11.1, 11.2 in the region of the pocket 2. In such a manner, differently distributed fastening points for different versions of ISO containers and interchangeable containers to be fixed on the side members 11.1, 11.2 can be provided via the locating stud units 3.1 to 3.4. Basically, the (upper) locating stud units 3.1 to 3.4 can also be detachably fixed to the side members 11.1 and 11.2 so that a locating stud unit 3.1 to 3.4 can also be completely removed from a side member 11.1 or 11.2 if required.

In addition to this, additional (lower) locating stud units are provided on the inner sides of the side members 11.1 and 11.2. Here, two locating stud units are provided on each side member 11.1, 11.2 of which in the attached figures merely locating stud units 4.1, 4.2 and 4.4 are visible. Each locating stud unit 4.1, 4.2 or 4.4 comprises a bearing block 41, via which the respective locating stud unit 4.1, 4.2 or 4.3 is held on the inner side of a side member 11.1 or 11.2. On each bearing block 41 a locating stud 40 is formed which can be utilized for fixing an ISO container. The individual locating stud units 4.1, 4.2 and 4.4 here can basically also be mounted so as to be longitudinally moveable on a side member 11.1 or 11.2 in order to achieve an additional flexibilization of different container sizes and be able to position the locating stud units in different positions on a side member 11.1 or 11.2.

Basically, position and number of the locating stud units 3.1 to 3.4 and 4.1, 4.2, 4.4 are not restricted. For example, an additional locating stud unit 3.5 can also be provided on a side member 11.2 in accordance with the representation in FIG. 3. Basically, the locating stud units 3.1 to 3.5 as well as 4.1, 4.2 and 4.4 can be embodied so as to be rollable in order to be able to accommodate ISO containers and interchangeable containers of different size both above and also within a pocket 10 on the double pocket wagon 1.

As is illustrated in particular in different views by way of the FIGS. 8A to 11B, in particular a flexible loading of the double pocket wagon 1 with containers C45, C40 and C20 of different size is made possible by way of the shown configuration of the double pocket wagon 1.

For example, a 45 foot container C45 can be loaded on each pocket wagon 1A, 1B according to the representations of FIGS. 8A to 8D. Here, such a 45 foot container C45 is placed onto the loading surfaces 120 and 130 of the head piece 12 and of the end piece 13. The pivotably mounted locating studs 300 of the locating stud units 3.1 to 3.4 are pivoted in a non-usage position here. The respective 45 foot container C45 is neither supported on a basin 2 nor is present within a pocket 10 of the pocket wagon 1A or 1B. The double pocket wagon 1 is rather structured in such a manner that the 45 foot container C45 when loaded as intended extends over the pocket 10 and the basin loading surface 20 of the mounted basin 2. Even when loading a 45 foot container C45, the basin 2 can thus be mounted on the side members 11.1 and 11.2 and easily transported along.

Figure 9A:
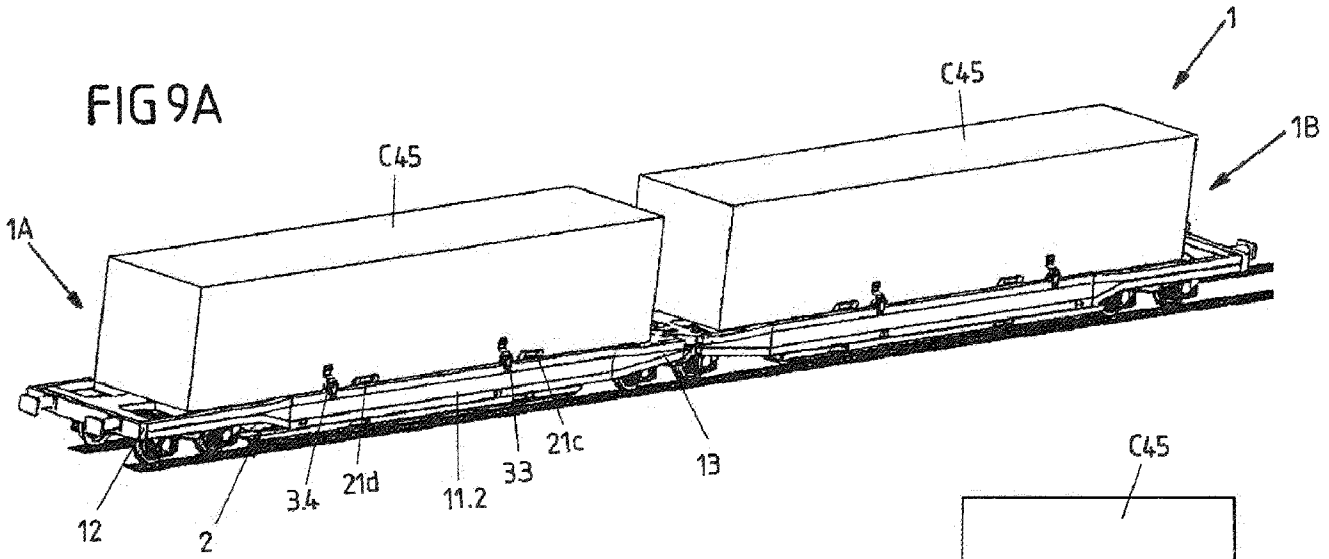
FIGS. 9A-9B show in views corresponding to the FIGS. 8C and 8D the double pocket wagon with mounted basins loaded with 45 foot containers.
Figure 9B:
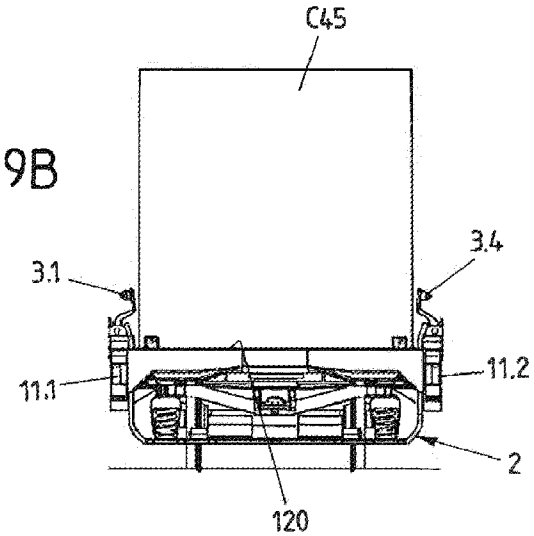

Accordingly, the FIGS. 8A to 8D illustrate the double pocket wagon 1 loaded with two 45 foot containers C45 without basins 2, while the FIGS. 9A and 9B illustrate the same loading situation with two 45 foot containers C45 with mounted basins 2.

Figure 10A:
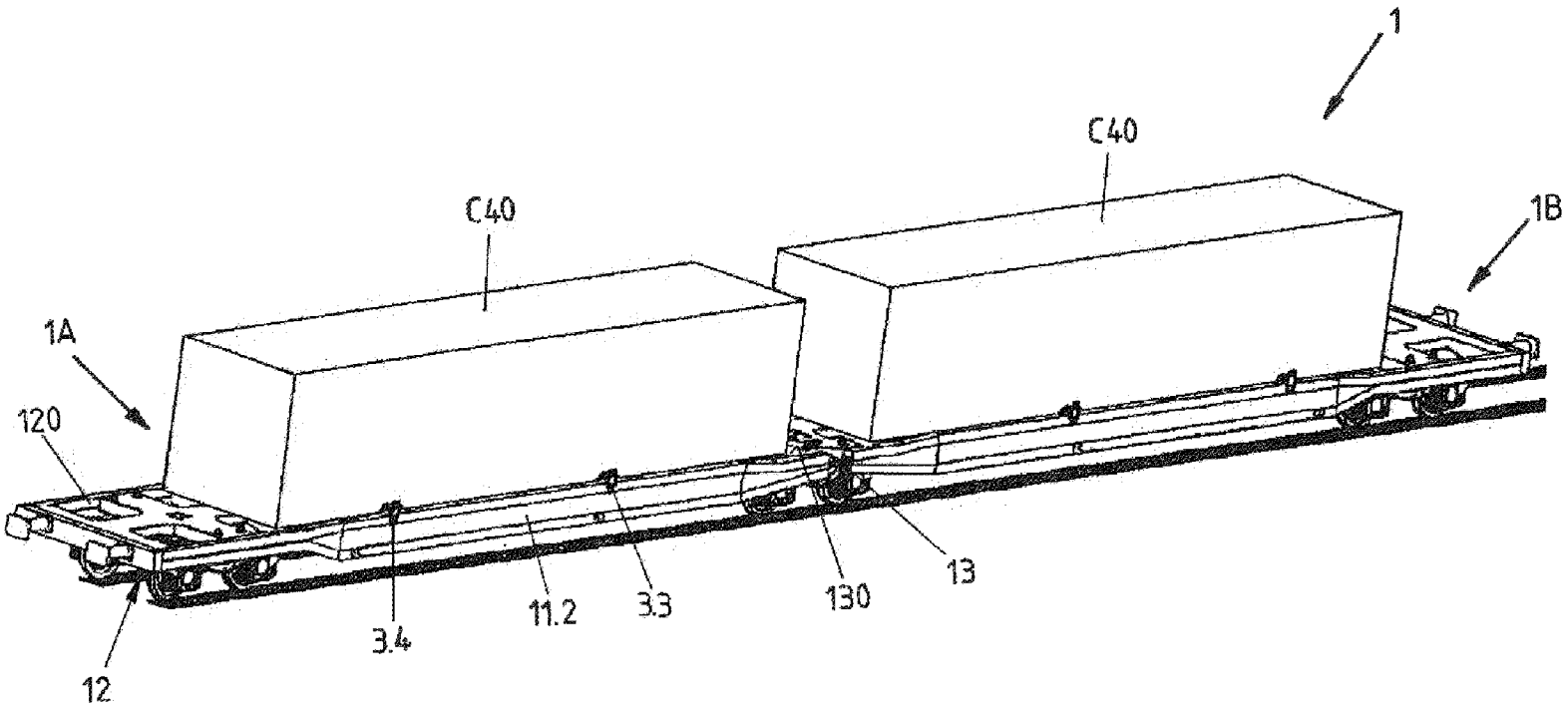
FIGS. 10A-10B show the double pocket wagon loaded with 40 foot containers without mounted basins (FIG. 10A) and with mounted basins (FIG. 10B) each in perspective view.
Figure 10B:
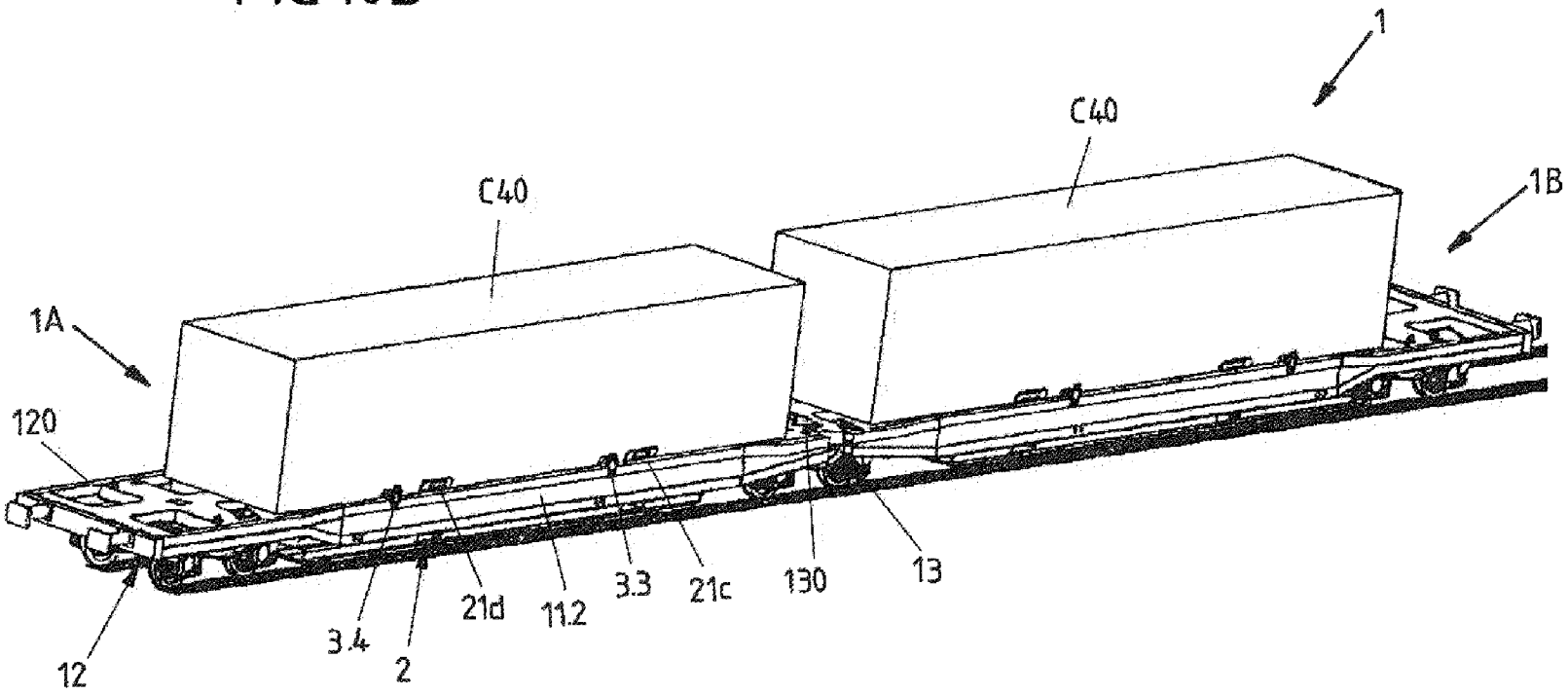

Transporting 40 foot containers C40 according to the FIGS. 10A and 10B is also possible independently of the basin 2. Here, a transport position for a 40 foot container C40 is predefined by way of the locating studs 300, pivoted into the usage position thereof, of the upper locating stud units 3.1 to 3.4, in which transport position these 40 foot containers C40 also extend over a pocket 10 and thus over a basin 2 mounted therein.

Figure 11A:
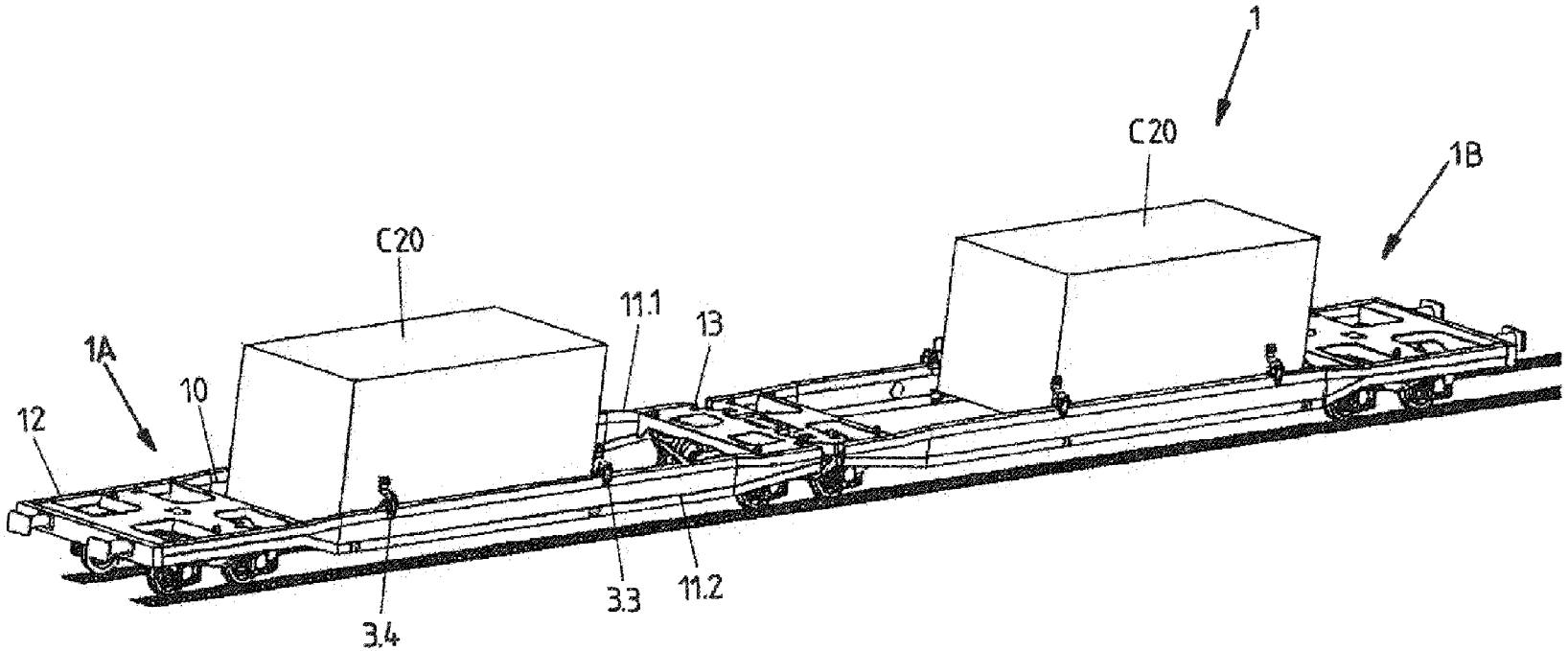
FIGS. 11A-11B show in views corresponding to the FIGS. 10A and 10B the double pocket wagon loaded with 20 foot containers with and without basin.
Figure 11B:
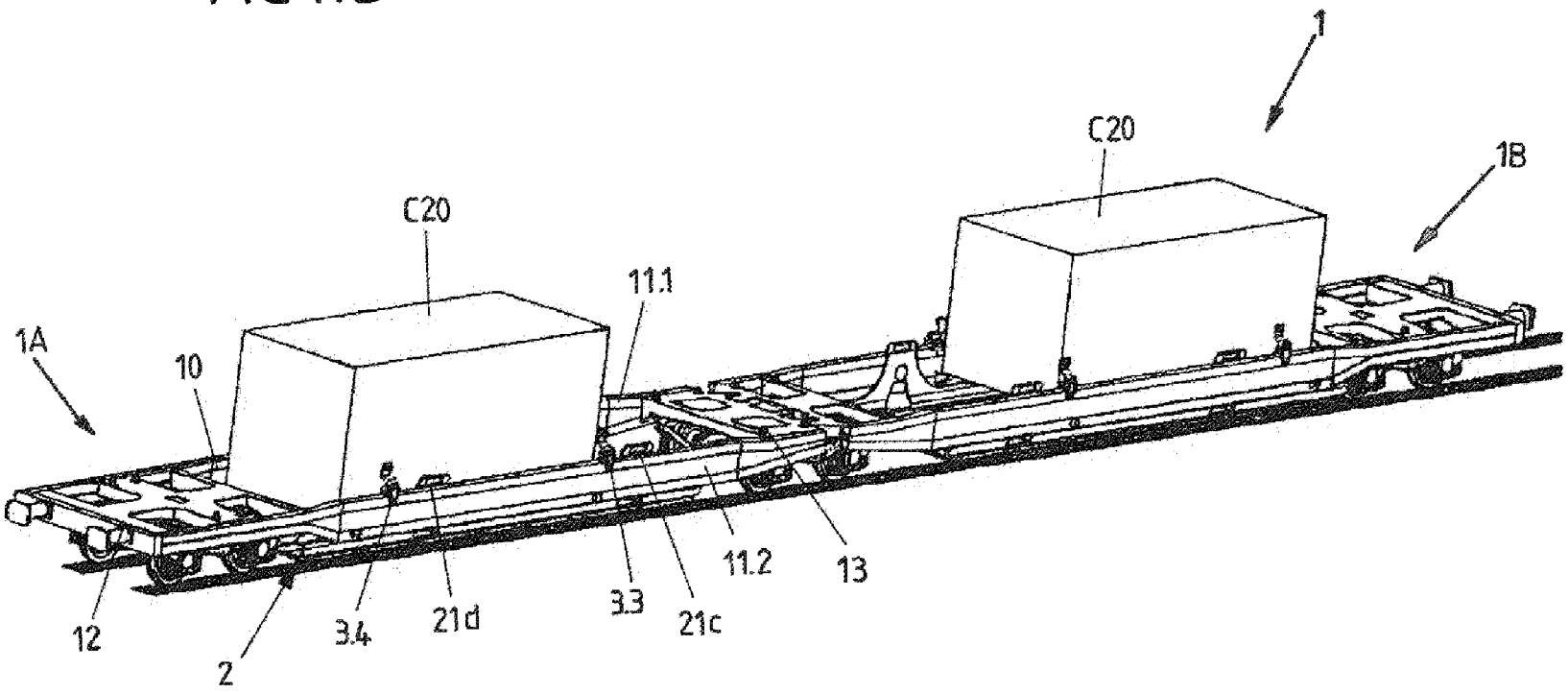

The same applies to a transport position for 20 foot containers C20 predefined with the lower locating stud units 4.1, 4.2 and 4.4 according to the FIGS. 11A and 11B. The 20 foot containers C20 partly rest within a pocket 10 by way of the locating stud units 4.1, 4.2 and 4.4 arranged on the inner sides of the side members 11.1 and 11.2 (and thus within the pocket 10) when they were loaded as intended on the double pocket wagon 1. However, it is also ensured by way of the arrangement of the locating stud units 4.1, 4.2 and 4.4 relative to the mounting studs 110*a* and 110*b* for the mounted basin 2 that the 20 foot container C20 is situated in the transport position above the basin loading surface 20 of the mounted basin 2 predefined for said container and consequently is neither supported on the basin loading surface 20 nor the transportability of the basin 2 being influenced by being loaded with a 20 foot container C20.

Furthermore, in order to be able to transport with the basin 2 different goods that are not easily cranable in an efficient manner, the basin 2 comprises a ramp assembly 200 shown in the FIGS. 12A to 16B in different configurations and ramp positions.

This ramp assembly 200 comprises multiple (here four) ramps 201, 202, 203 and 204 as well as two ramp extensions 205 and 206. Here, the ramps 201 to 204 and ramp extensions 205, 206 of the ramp assembly 200 are predefined different ramp positions on the basin loading surface 20, which simplify an efficient loading of the basin 2 with different goods.

Figure 12A:
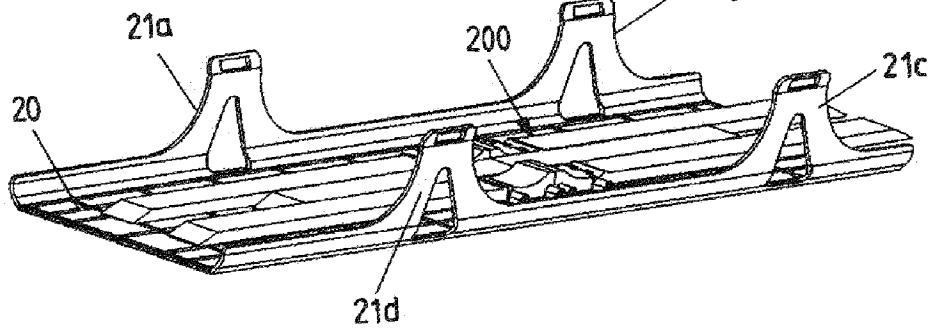
FIGS. 12A-12B show in different views a basin provided for mounting in a pocket of the double pocket wagon of FIG. 1 with a ramp assembly arranged thereon in a first ramp position.
Figure 12B:
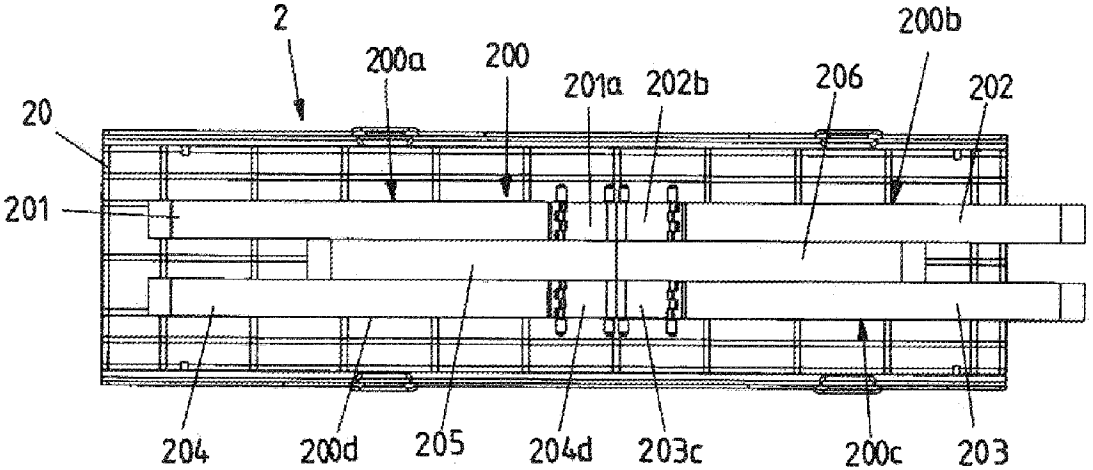
Figure 13A:
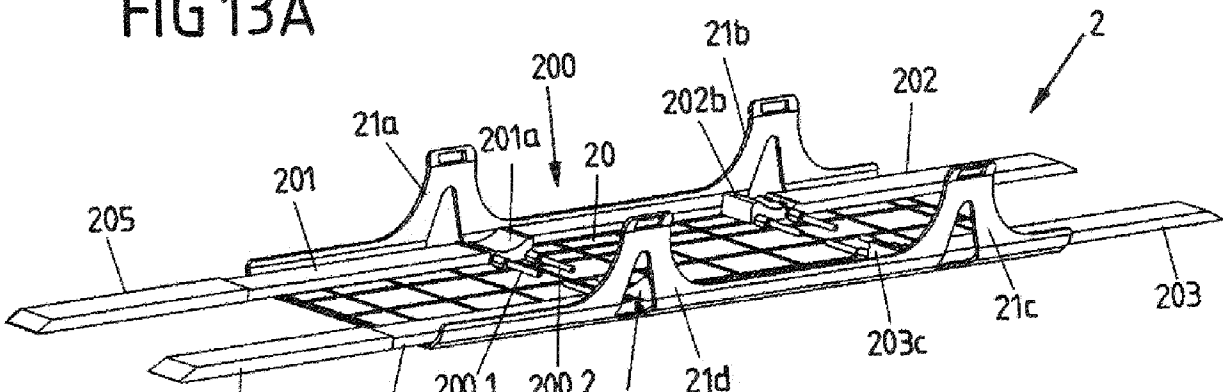
FIGS. 13A-13B show in views corresponding to the FIGS. 12A and 12B the basin with the ramp assembly in a second ramp position.
Figure 13B:
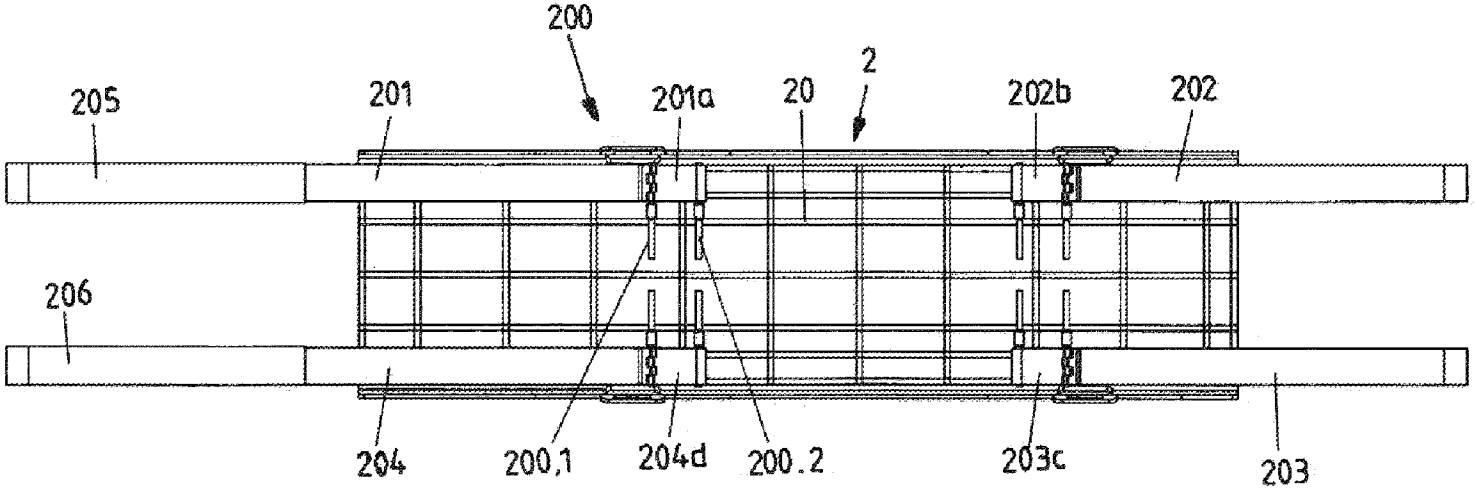
Figure 14A:
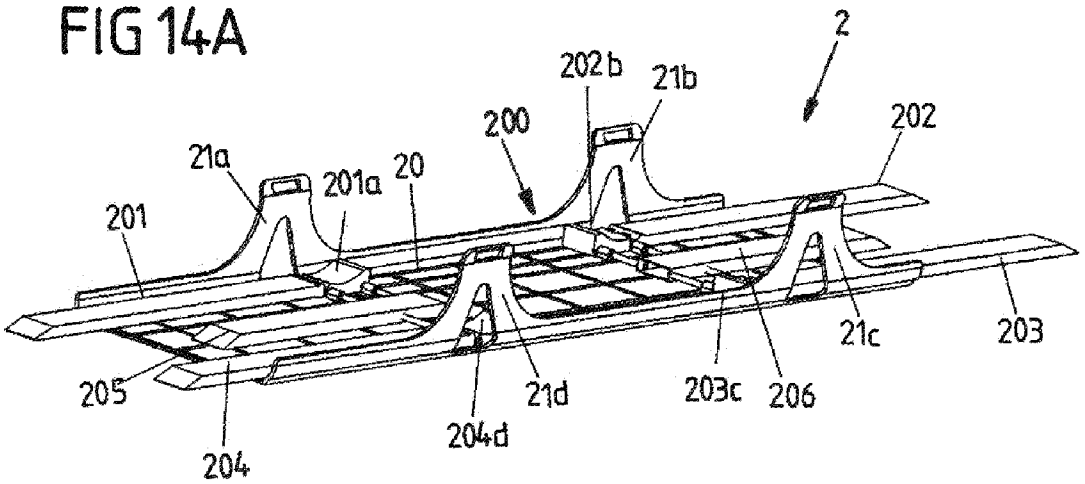
FIGS. 14A-14B show in views corresponding to the FIGS. 12A and 12B the basin with the ramp assembly in an alternative second ramp position.
Figure 14B:
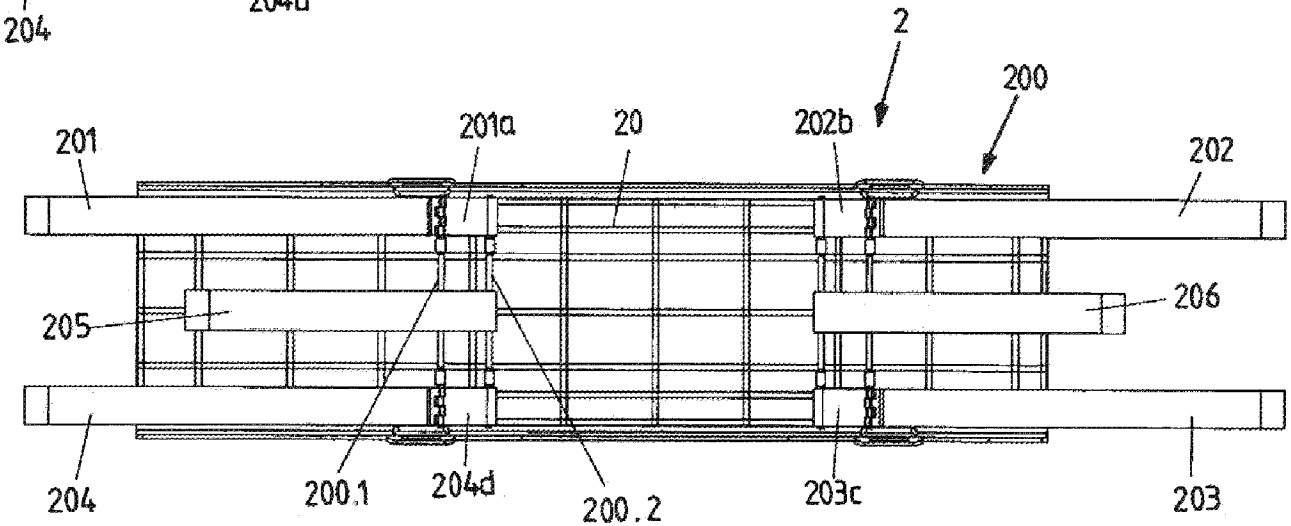
Figure 15A:
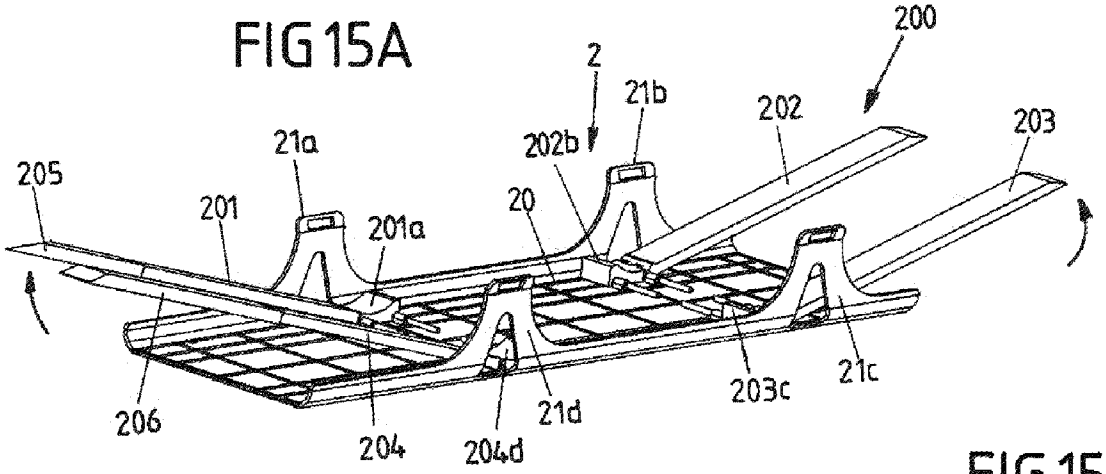
FIGS. 15A-15B show in views corresponding to the FIGS. 12A and 12B the basin of the FIGS. 13A and 13B with the ramp assembly present in the second ramp position and ramps of the ramp assembly pivoted relative to a basin loading surface.
Figure 15B:
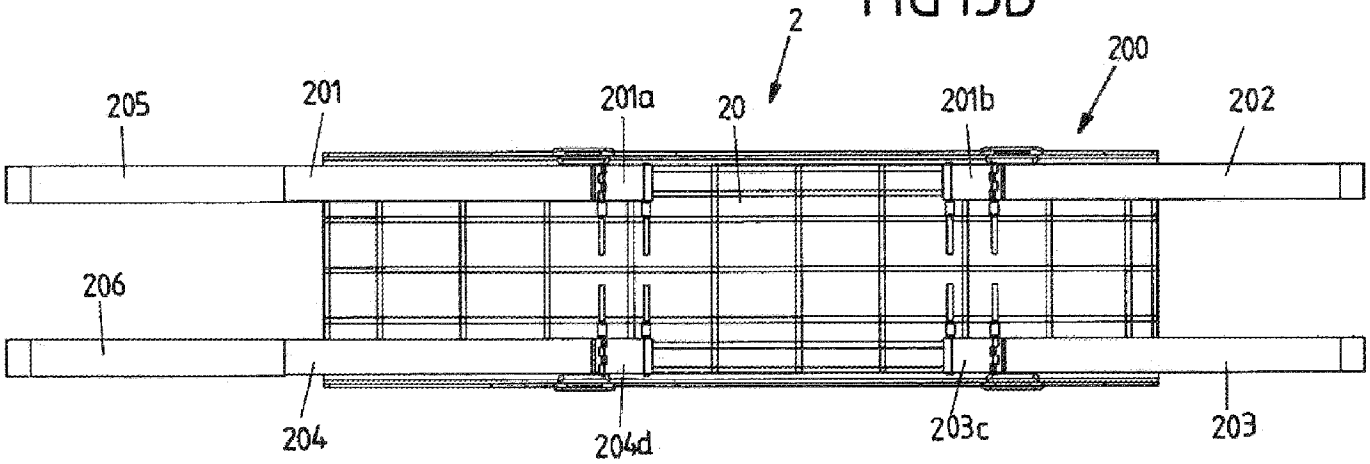
Figure 16A:
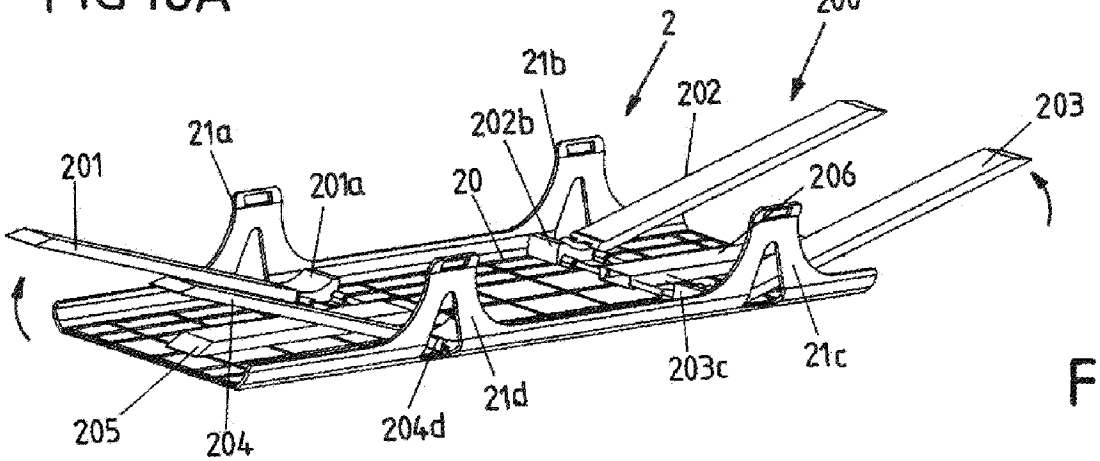
FIGS. 16A-16B show in views corresponding to the FIGS. 12A and 12B the basin of FIGS. 14A and 14B with the ramp assembly in the alternative second ramp position and ramps of the ramp assembly pivoted relative to a basin loading surface.
Figure 16B:
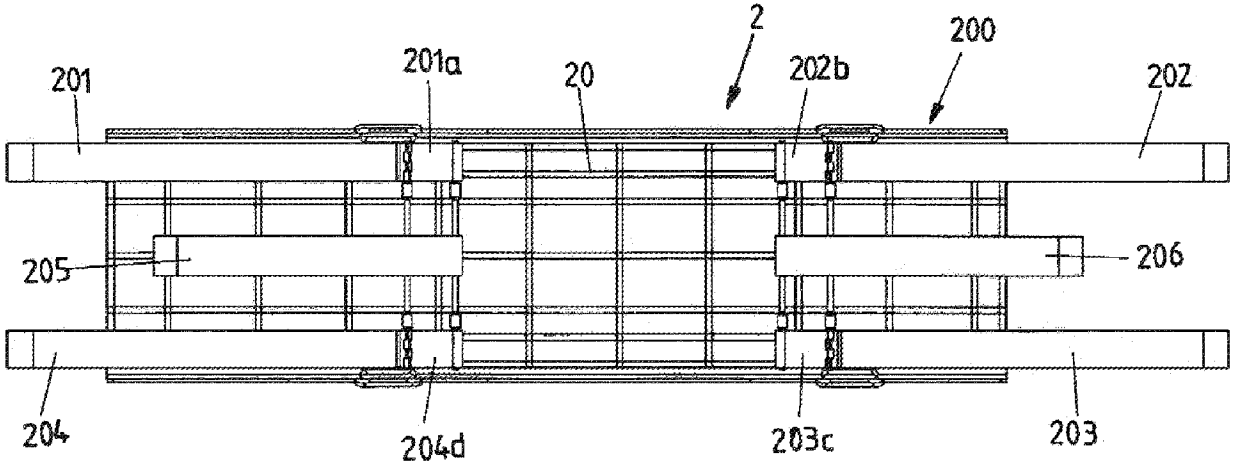

In a first ramp position illustrated in different views in the FIGS. 12A and 12B the four ramps 201 to 204 are present in pairs with ramp extensions 205, 206 received between each two ramps 201/204 or 202/203. Each ramp 201 to 204 comprises an articulated bearing part 201*a*, 202*b*, 203*c* or 204*d* via which the respective ramp 201, 202, 203 or 204 is fixed on the basin loading surface 20.

A ramp unit 200*a*, 200*b*, 200*c* or 200*d* of a ramp 201, 202, 203 or 204 is articulated on each articulated bearing part 201*a* to 204*d*. The respective ramp unit 200*a*, 200*b*, 200*c* or 200*d* of a ramp 201, 202, 203 or 204 projects the (first) ramp position illustrated in the FIGS. 12A to 12B only slightly or not at all over the longitudinally extended basin loading surface 20 and is substantially positioned centrally on the basin loading surface 20. Further, in this first ramp position, the two ramp extensions 205 and 206 are detachably fixed on the articulated bearing parts 201*a* to 204*a* via fixing pins 200.1 and 200.2 and thus likewise held on the ramp surface 20 of the basin 2 in its defined position.

Figure 17A:
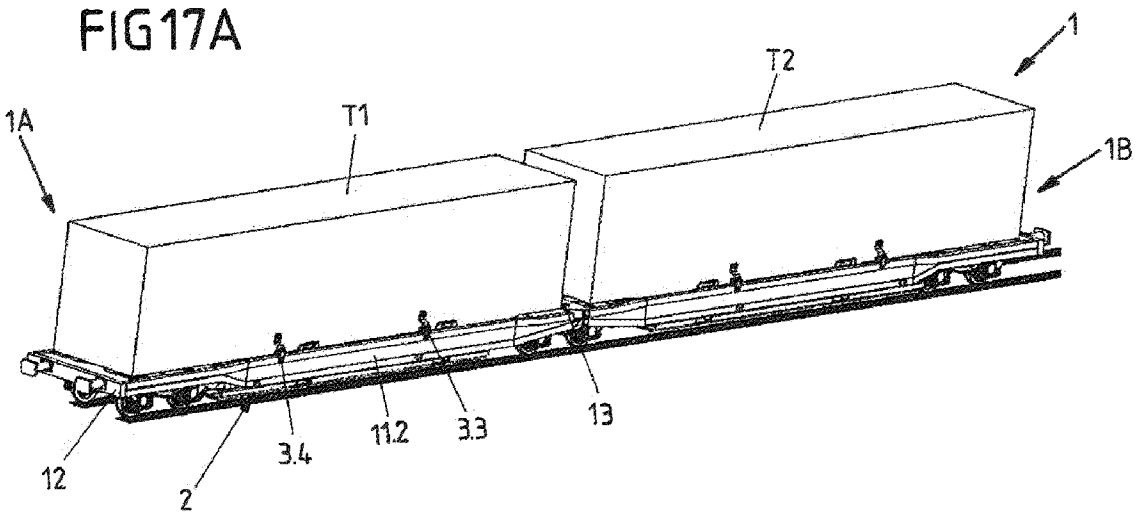
FIGS. 17A-17B show in different views the double pocket wagon of FIG. 1 loaded with two semi-trailers.
Figure 17B:
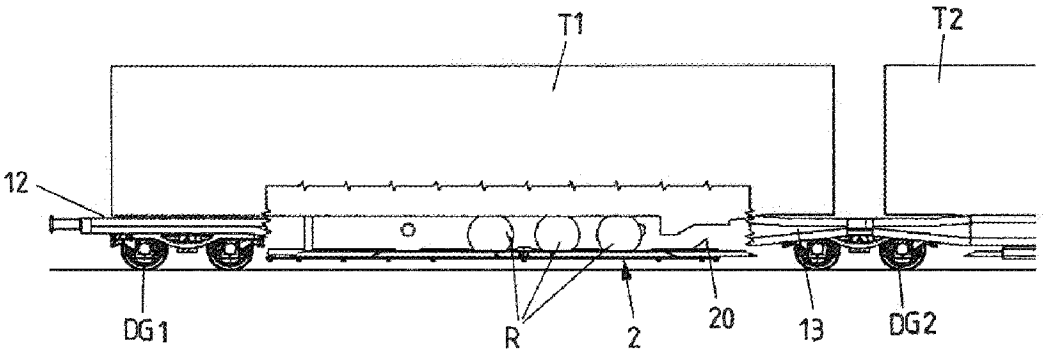
Figure 18A:
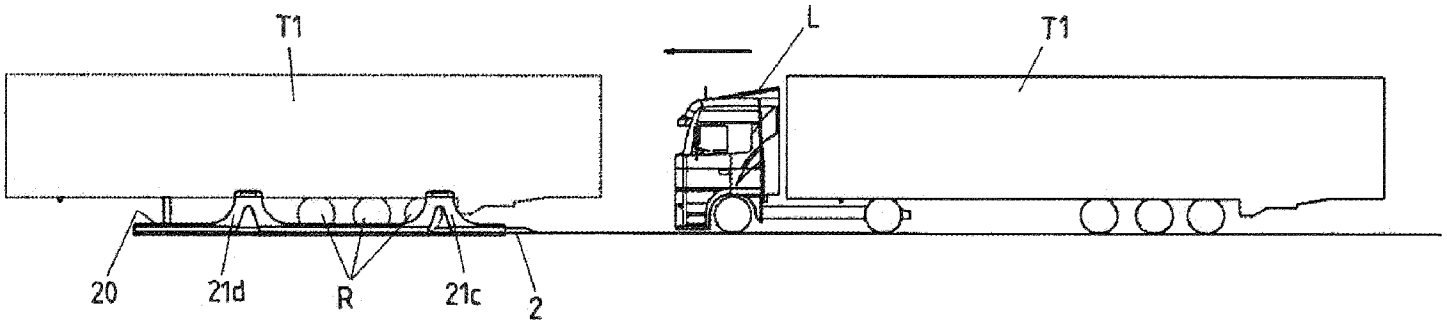
FIGS. 18A-18B show representations of the driving-in and parking-off of a semi-trailer on a basin, by means of which the semi-trailer is loaded into a pocket of the double pocket wagon.
Figure 18B:
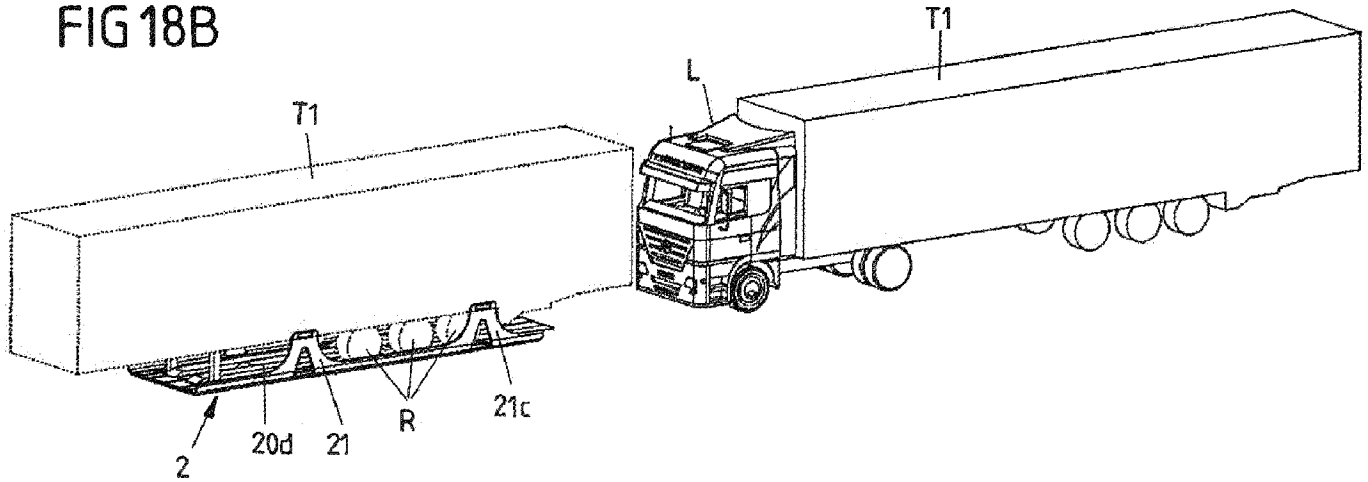
Figure 19:
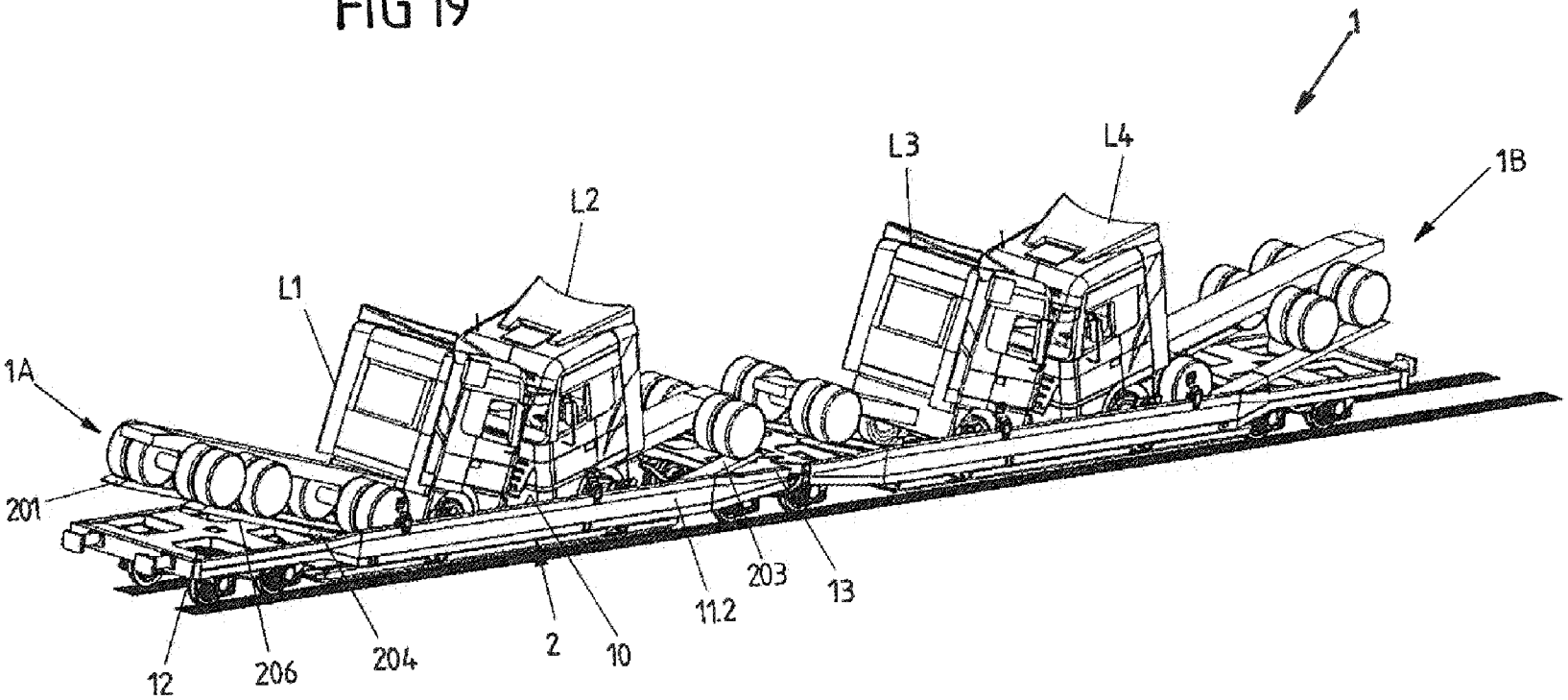
FIG. 19 shows the double pocket wagon of FIG. 1 loaded with multiple truck tractors which are arranged on a basin in pairs.
Figure 20:
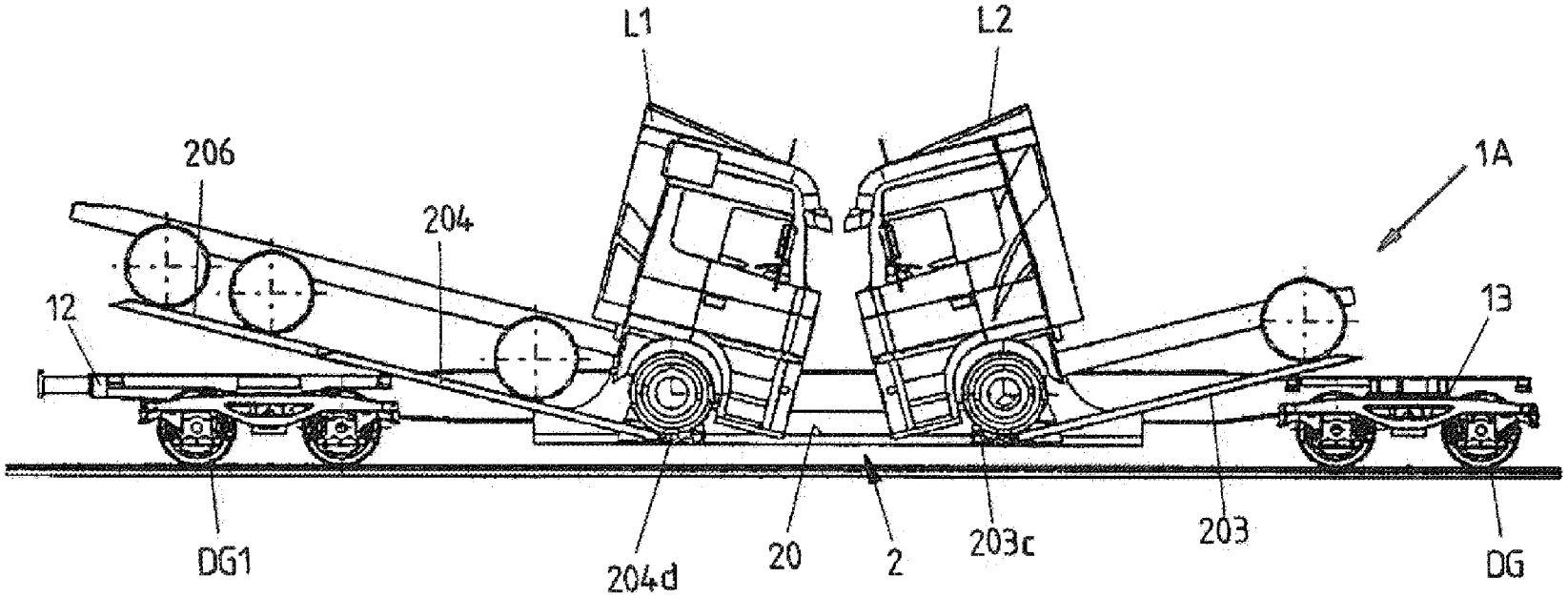
FIG. 20 shows a sectional representation of the double pocket wagon looking onto a basin loaded with two truck tractors.
Figure 21A:
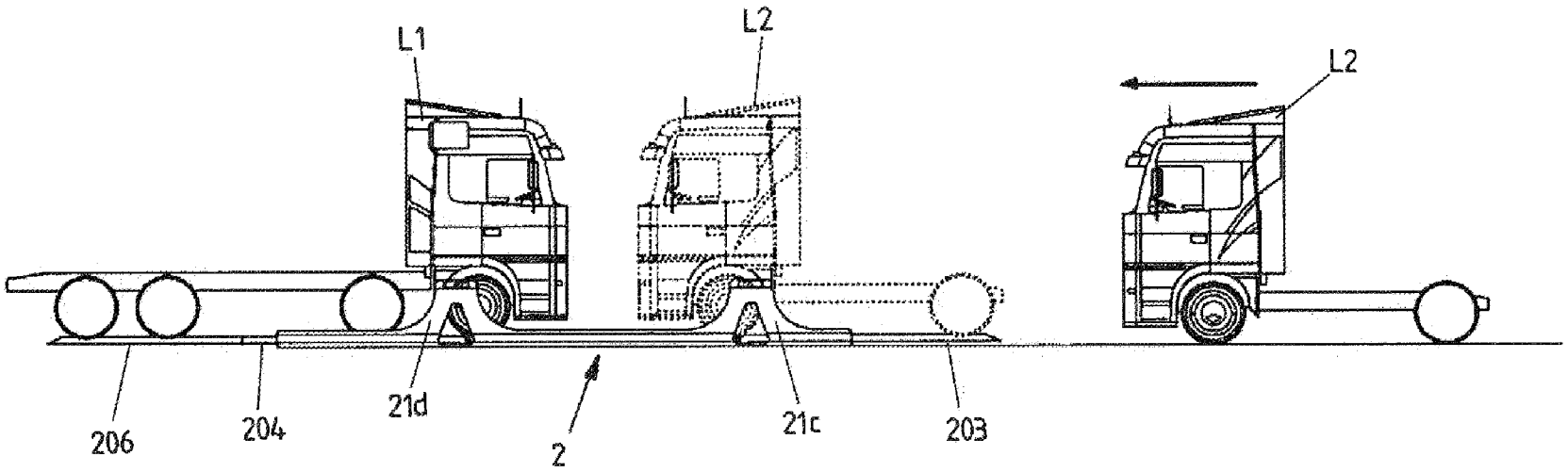
FIGS. 21A-21B show in different views representations for driving-in the truck tractors into a basin by means of which the truck tractors are arranged in a pocket of the double pocket wagon.
Figure 21B:
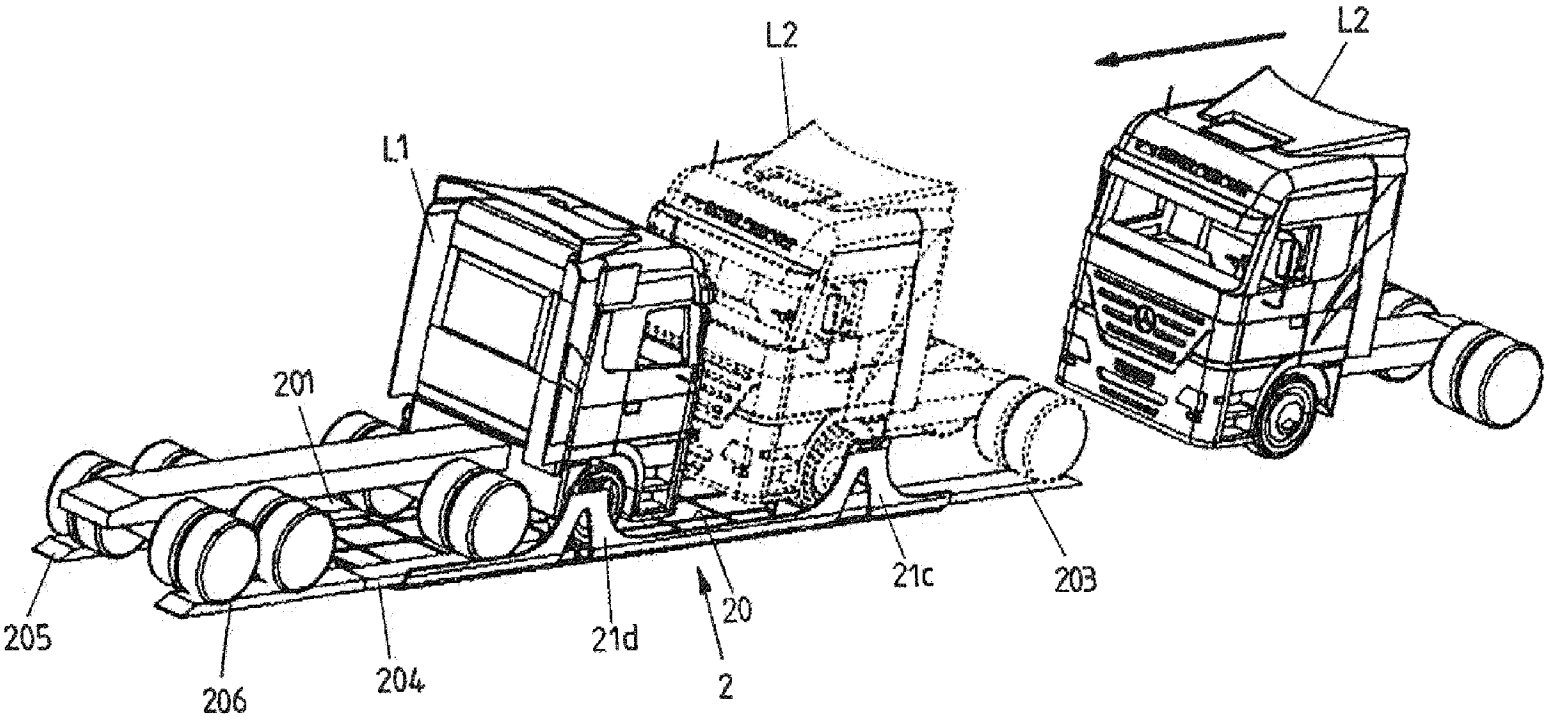

The first ramp position of the ramp assembly 200 shown in the FIGS. 12A and 12B is equipped and provided for the loading of the basin 2 with a semi-trailer T1 or T2 according to the FIGS. 17A and 18B. With the basin 2 removed and placed on a ground, for example the semi-trailer T1 can be driven into the basin 2 by means of a truck tractor L and fixed on the basin loading surface 2 (see FIGS. 18A and 18B). The individual components of the ramp assembly 200 are then present centrally between wheels R of the semi-trailer T1. The semi-trailer T1 driven onto the basin 2 and secured thereon can then be loaded by means of the basin 2 into the pocket 10 of a pocket wagon 1A or 1B of the double pocket wagon 1, as is shown in the FIGS. 17A and 17B for the two semi-trailers T1 and T2. A kingpin of the respective semi-trailer T1 or T2 is then received and secured on the pin hitch 121 of the respective head piece 12.

As is illustrated by way of the FIGS. 13A-13B and 15A-15B, a ramp assembly 200 can be arranged on the basin 2 also in a predefined second ramp position. In the second ramp position, the ramps 201 to 204, compared with the first ramp position, are offset transversely and parallel with respect to an extension direction of the ramps 201 to 204. Accordingly, the ramps 201 to 204 offset parallel to the illustrated second ramp position (relative to the first ramp position) protrude further over a front-side edge of the basin 2 than in the first ramp position and thus provide a transport surface for a truck tractor L1 to L4 that is extended over the edge of the basin 2 (see for example FIG. 19). Here, the individual ramps 201 to 204 are present in pairs in the region of the two longitudinal side ends of the basin loading surface 20 in such a manner that each ramp 201 to 204 protrudes with its ramp unit 200*a* to 200*d* over a front-side end of the basin loading surface 200. On two ramps 201 and 204 assigned to a longitudinal side, the ramp extensions 205 and 206 can then be arranged furthermore, so that on the two front sides of the basin loading surface 20, accessible ramps of different lengths protrude. The ramps 201 to 204 of the two pairs of ramps 201/204 and 202/203 here are substantially arranged spaced apart transversely from one another corresponding to the track width of a truck tractor L1 to L4, so that a truck tractor L1, L2, L3 or L4 driven onto the basin 2 stands with its wheels on the ramps 201 to 204 and ramp extensions 205 and 206 according to the FIGS. 19, 20 and 21A to 21B.

By way of the pivotable mounting on the articulated bearing parts 201*a* to 204*d* it is then achieved when mounting the basin 2 with the truck tractors L1/L2 or L3/L4 positioned thereon that two truck tractors L1 and L2 or L3 and L4 positioned on a basin 2 can be tilted toward one another in the pocket 10, in which the basin 2 is mounted, and thus be arranged in a more space-saving manner. The ramps 201 to 204 protruding over the front sides of the basin loading surface 20, on which the truck tractors L1 to L4 rest, consequently protrude over a pocket 10 of the double pocket wagon 1 (significantly more than in a first ramp position). In such a manner, the ramps 201 to 204 in this configuration cannot be accommodated within the basin 2 and, during the loading process, lie against the head piece 12 and the end piece 13. Thus, upon the further lowering of the basin 2 into the pocket 10, the protruding ramp units 200*a* to 200*d* are pivoted on the articulated bearing parts 201*a* to 204*d*. The second ramp position of the ramp assembly 200 is accordingly predefined in such a manner that truck tractors L1, L2 or L3, L4 positioned on the basin 2—on mounting the basin 2 in the pocket 1 and otherwise without further action—are tilted toward one another.

By way of the FIGS. 14A-14B and 16A-16B it is illustrated further that for positioning truck tractors L1 to L4 on the basin 2 the ramp extensions 205 and 206 obviously need not be essentially arranged on the ramps 201 to 204. The ramp extensions 205 and 206 can also remain fixed on the basin loading surface 20 centrally between two ramps 201, 204 or 202, 203. In such a manner, the ramp extensions 205 and 206 can be easily carried along even when no truck tractors L1 to L4 are positioned thereon, for example because merely two-axle truck tractors L2, L3 have to be carried along on the double pocket wagon 1.

Figure 22:
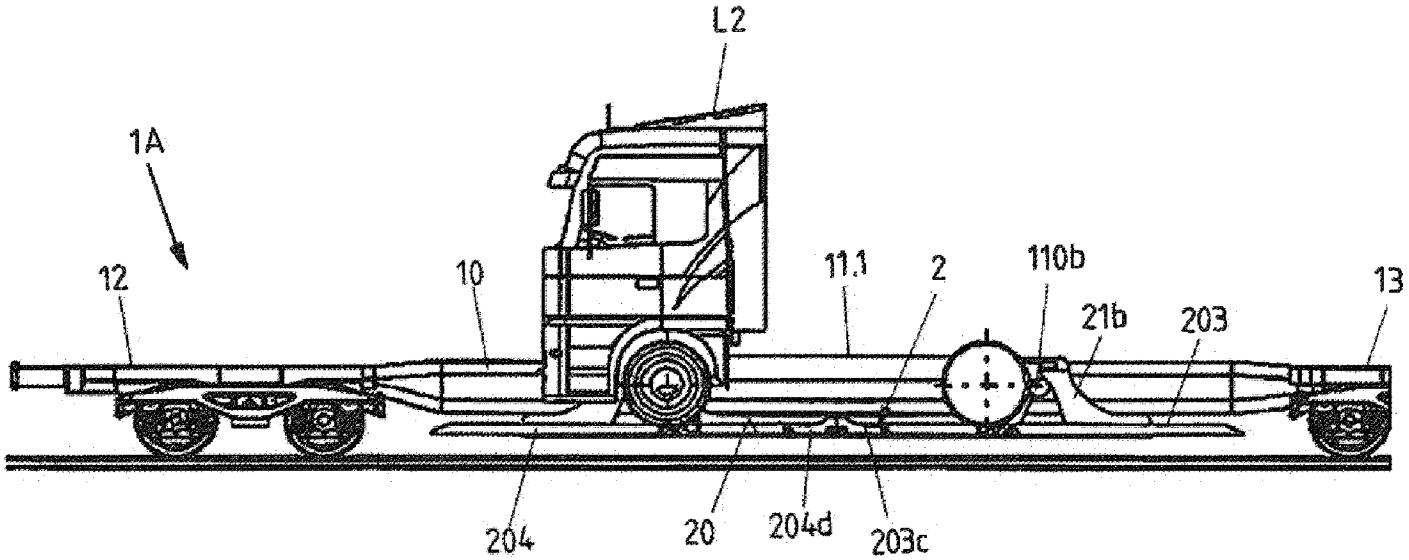
FIG. 22 shows in sectional representation a pocket of the double pocket wagon, in which on a basin loading surface of the basin mounted in the pocket exactly one truck tractor is placed.
Figure 23A:
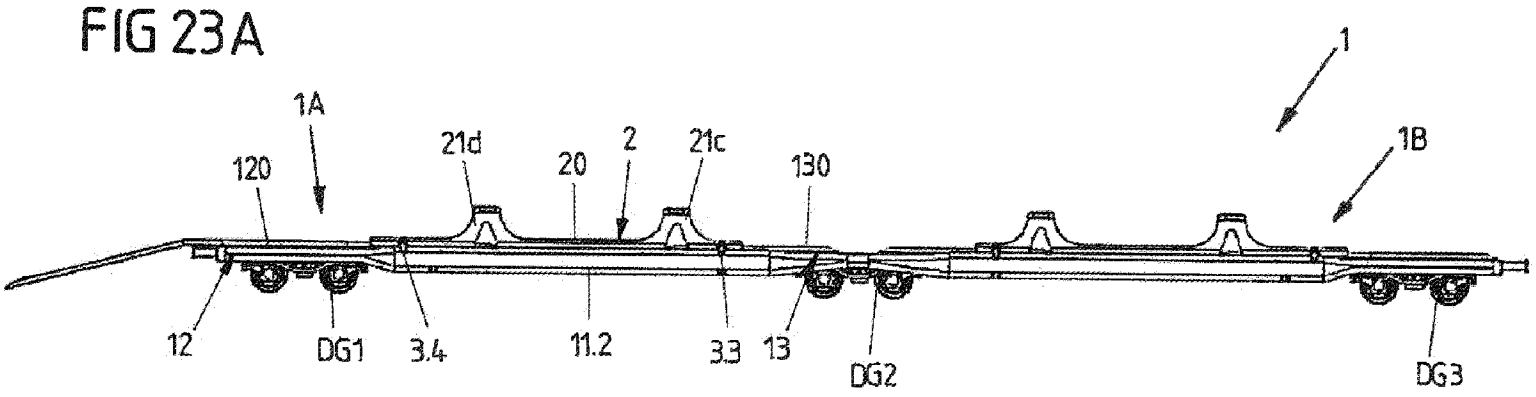
FIGS. 23A-23B show in different views the double pocket wagon of FIG. 1 with basins which are fixed on the double pocket wagon in a function position, in which a basin loading surface of the respective basin is held at the height of a loading surface of a head piece and a loading surface of an end piece of the double pocket wagon.
Figure 23B:
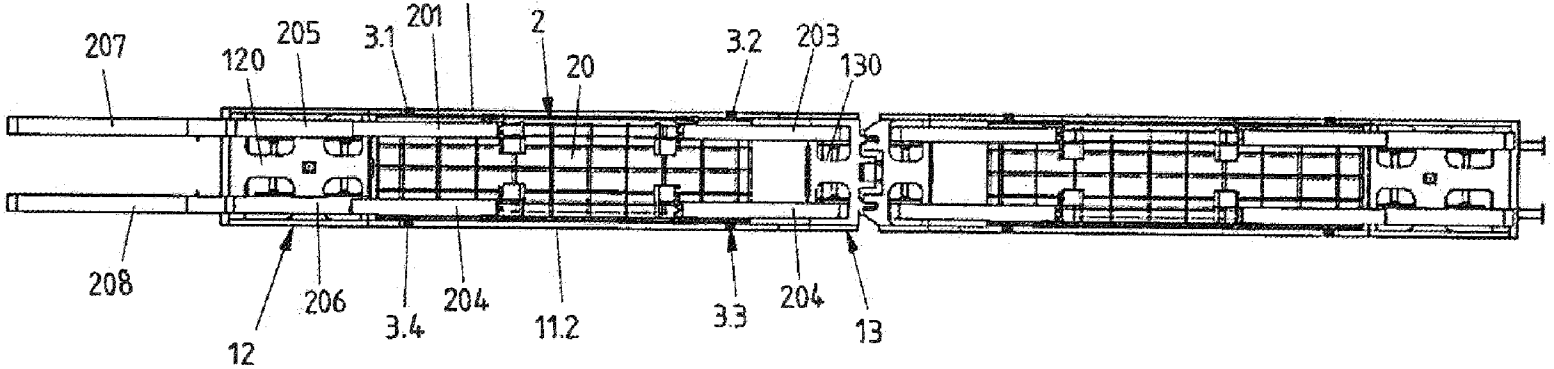
Figure 24:
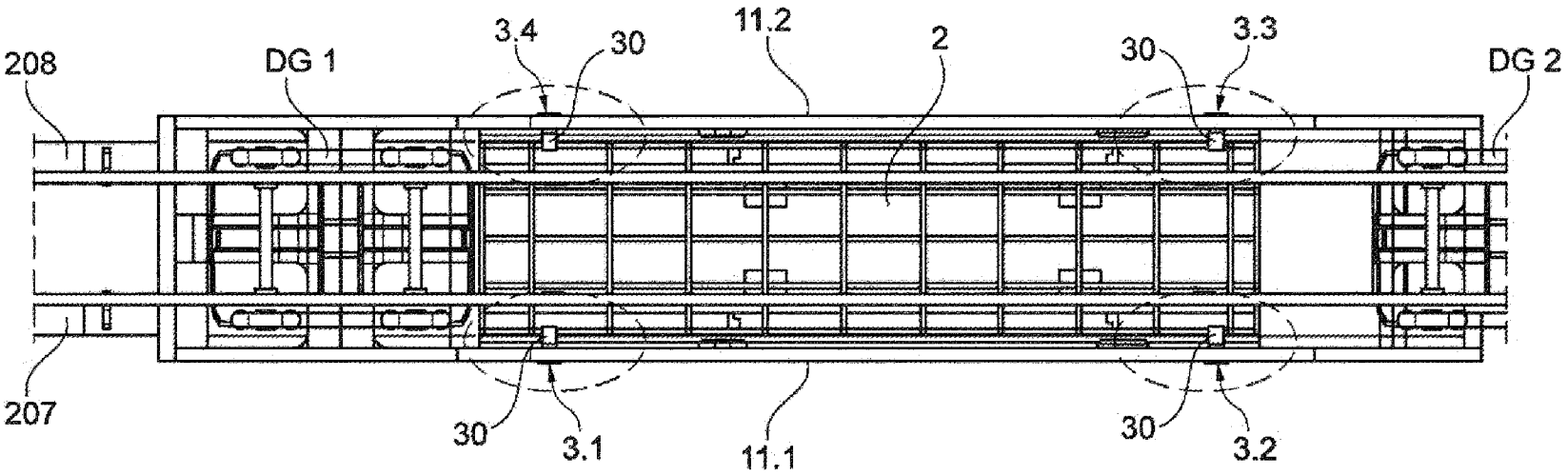
FIG. 24 shows in an enlarged scale a view of the lower side of the double pocket wagon of FIGS. 23A and 23B.
Figure 25:
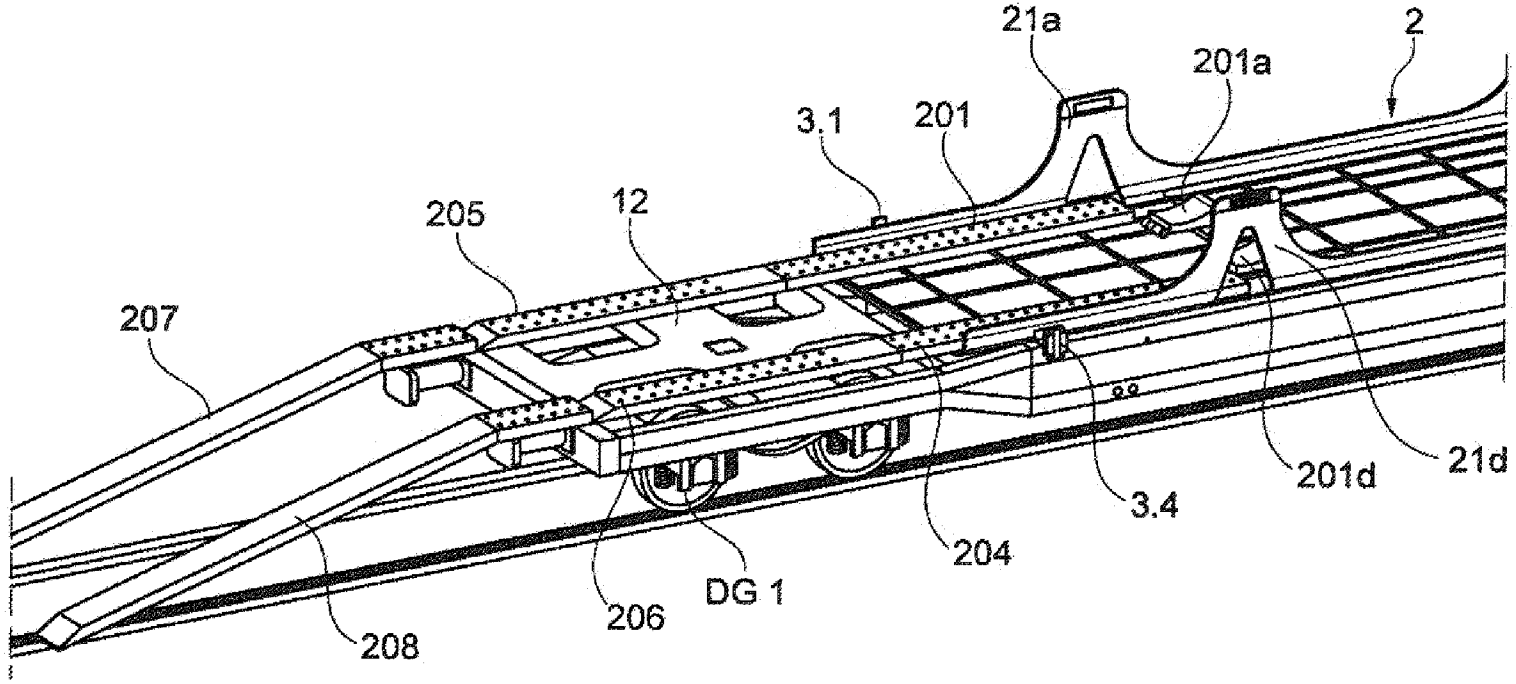
FIG. 25 shows in an enlarged scale and by way of an extract an end of the double pocket wagon on the head piece side with driving-up ramps fastened thereon for loading the double pocket wagon of FIGS. 23A and 23B.
Figure 26A:
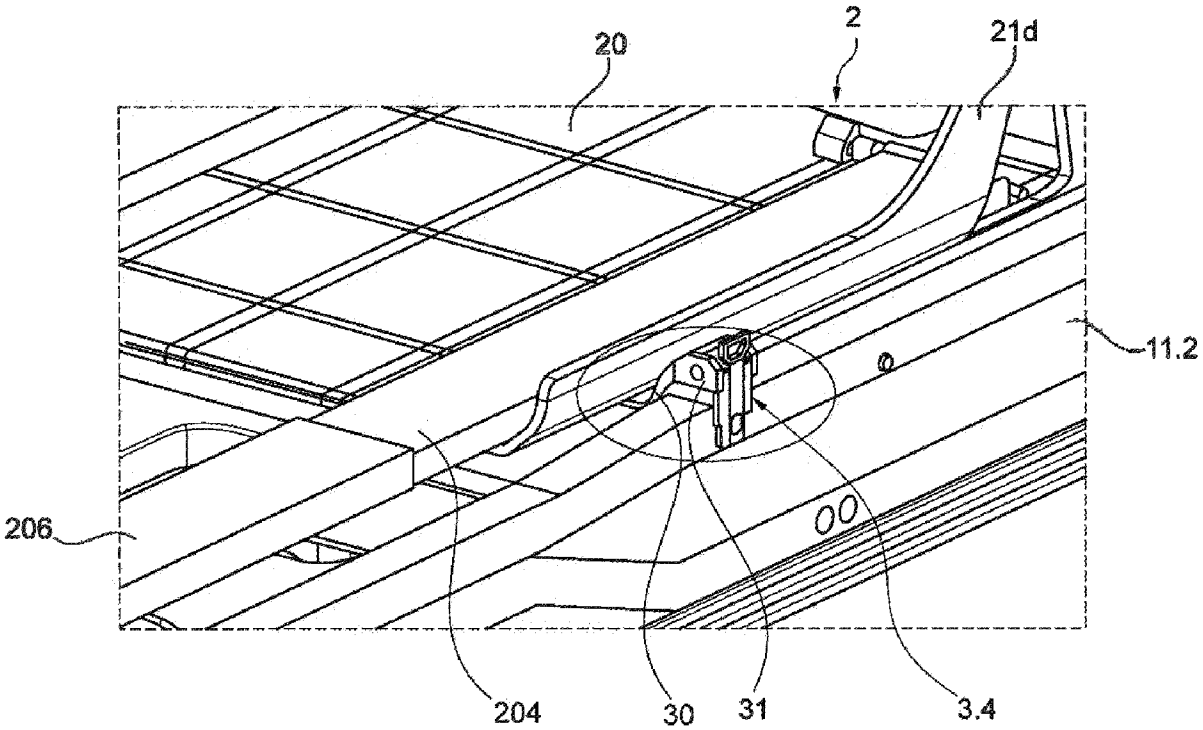
FIGS. 26A-26B show enlarged representations of the double pocket wagon looking at the region on which fastening elements of the double pocket wagon are provided, which predefine the function position of a basin and in addition to this can also be utilized for fixing containerized goods (without basin)
Figure 26B:
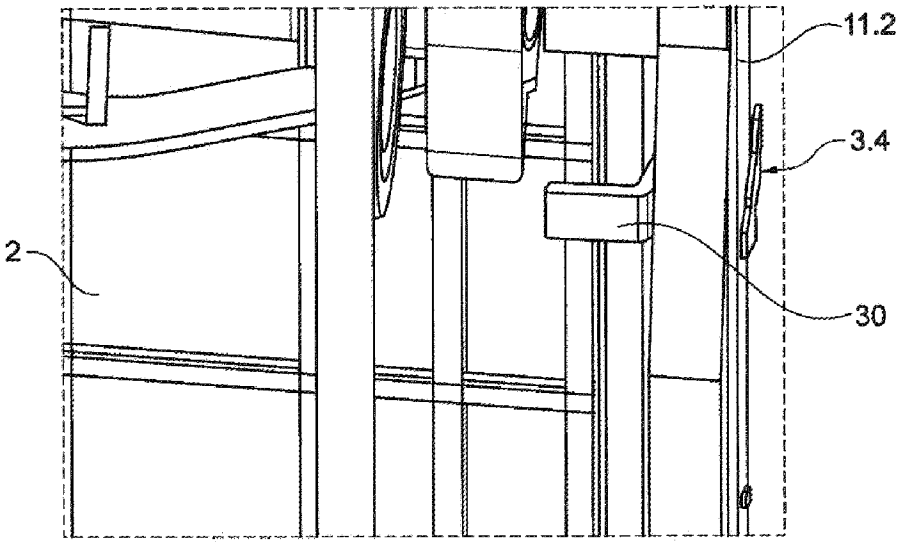
Figure 27:
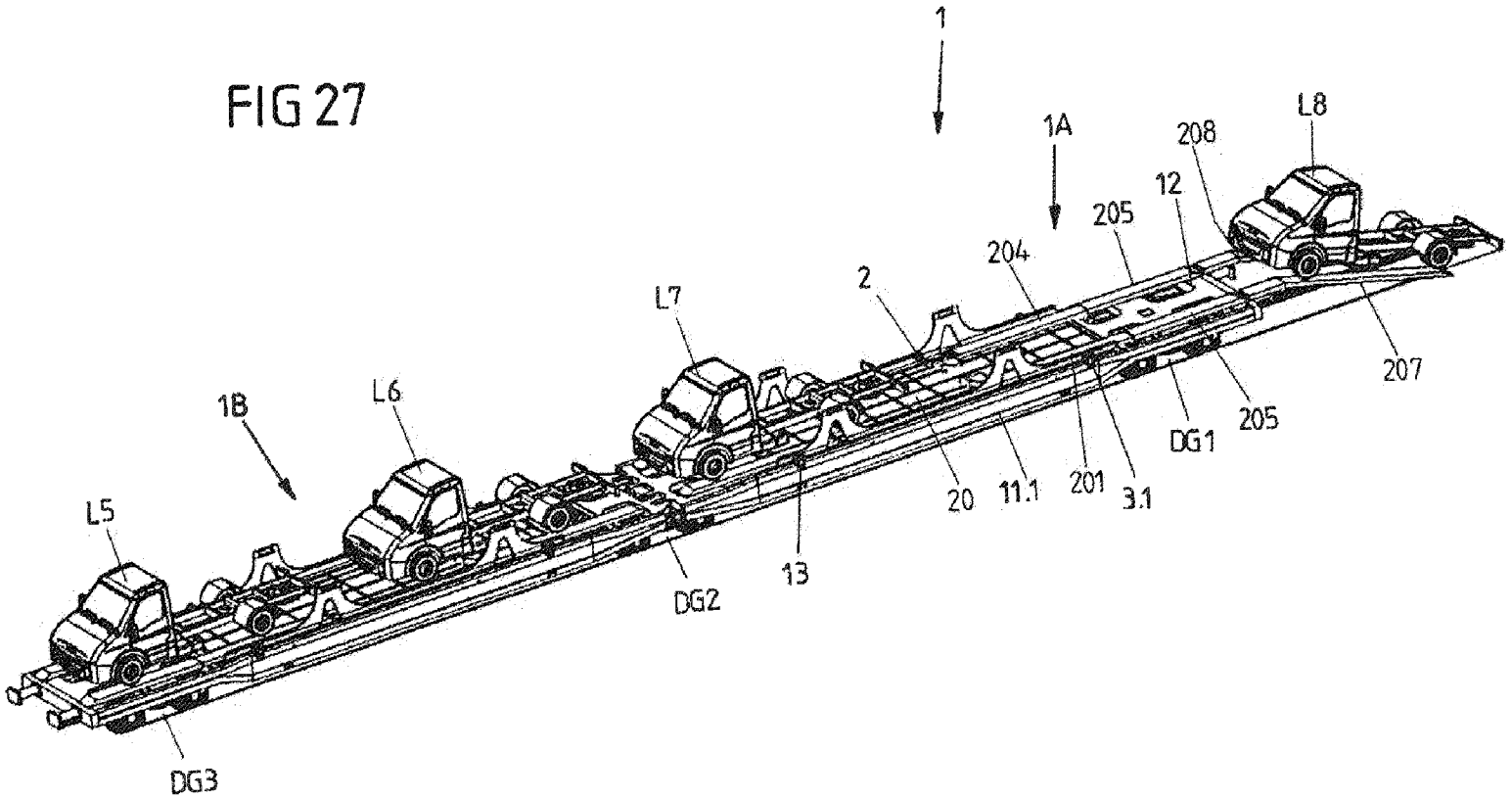
FIG. 27 shows a perspective view of the double pocket wagon with basins each present in a function position, which are loaded with truck tractors in a roll-on method.

As is illustrated in the sectional representation of FIG. 22, the proposed construction of the double pocket wagon 1 with the basin 2 mounted in the pocket 10 also allows transporting an individual truck tractor L2 without problem. Here, the truck tractor 2 is then positioned completely on the basin loading surface 20 and transported by means of the basin 2 in the pocket 10 of a pocket wagon 1A or 1B double pocket wagon 1.

By way of the FIGS. 23A-23B, 24, 25, 26A-26B and 27 it is illustrated, furthermore, that the double pocket wagon 1 can also be utilized for loading with goods by the roll-on/roll-off method. Here, a function position on the pocket 10 is predefined via the locating studs 300 of the upper locating stud units 3.1 to 3.4 of each basin 2 of a pocket wagon 1A, 1B pivoted into a usage position, in which the basin loading surface 20 of the respective basin 2 is positioned at the height of the loading surfaces 120 and 130 of the head piece 12 and of the end piece 13. Thus, a loading surface 120 on the head piece side, the basin loading surface 20 of the basin 2 and a loading surface 130 on the end piece side constitute a continuous wagon loading surface in the manner of a flat wagon, onto which the goods can be driven.

For predefining the function position of a basin 2 shown in the FIGS. 23A to 27, the locating units 3.1 to 3.4 can also be positioned differently, in particular differently compared with a position on the side members 11.1 and 11.2, which the locating stud unit 3.1 to 3.4 take up for loading the double pocket wagon 1 with one or more 40 foot containers.

On its lower side, the basin 2 comprises connecting openings in order to be able to place and fix the basin 2 on the locating studs 300 of the locating stud units 3.1 to 3.4. Here, carrying along additional fastening or fixing elements is not necessary. By way of the basin 2 and the fastening elements in the form of the locating stud units 3.1 to 3.4 and 4.1, 4.2, 4.4 provided on the side members 11.1, 11.2 located opposite one another can be configured in almost any way for transporting different goods.

In providing a continuous wagon loading surface through the basin 2 held on the locating studs 300 in a function position, the ramp assembly 200 of the basin 2 can, furthermore, be present in the second ramp position so that truck tractors L5 to L8 can be driven onto the ramps 201 to 204 and if applicable onto the ramp extensions 205 and 206. In order to make possible driving the truck tractors L5 to L8 onto the continuous wagon loading surface at an end of the double pocket wagon 1, usual loading/unloading ramps 207 and 208 for example are fixed on a head piece 12.

LIST OF REFERENCE NUMBERS

1 Double pocket wagon (goods wagon)
10 Pocket
11.1, 11.2 Side member
1100 Body
1101 Head
110*a*, 110*b* Mounting stud (fastening element)
12 Head piece
120 (Wagon-side) loading surface
121 Pin hitch
13 End piece
130 (Wagon-side) loading surface
1A, 1B Pocket wagon
2 Basin
20 Basin loading surface
200 Ramp assembly
200.1, 200.2 Fixing pin
200*a*-200*d* Ramp unit
201-204 Ramp
201*a*, 202*b* Articulated bearing part
203*c*, 204*d*
205, 206 Ramp extension
207, 208 Loading/unloading ramp

210 Connecting opening
211 Transport bar
21*a*-21*d* Mounting tab (connecting element)
3.1-3.5 (Upper) locating stud unit
30 Pivot bearing part
300 Locating stud (fastening element)
31 Bearing block
4.1, 4.2, 4.4 (Lower) locating stud unit
40 Locating stud (fastening element)
41 Bearing block
C20, C40, C45 Container
DG1, DG2, DG3 Bogie
G Articulated connection
l Length
L, L1-L8 Truck tractor/truck
R Wheels
T1, T2 Semi-trailer

The invention claimed is:

1. A goods wagon for transporting containerized goods, the goods wagon comprising a head piece at a front end of the goods wagon; an end piece at a rear end of the goods wagon; and two side members extending between the head piece and the end piece, wherein a basin for goods is provided, which defines a basin loading surface, and the side members define a pocket into which the basin is inserted, the basin is configured to be mounted in both a loading position and a function position to be used for different loading scenarios, on the side members, loading position fastening elements for the basin are provided, which predefine the loading position in the pocket of the goods wagon for the basin in which the basin loading surface is situated lower than a loading surface provided on the head piece and is situated lower than a loading surface provided on the end piece, the goods wagon is equipped and provided for transporting a containerized good independently of the basin in that a transport position is predefined on the goods wagon for the containerized good, in which the containerized good, with the basin present in the loading position, extends above the basin loading surface over at least one part of the basin loading surface, and function position fastening elements are provided on the side members, which predefine the function position on the pocket of the goods wagon for the basin, in which the basin loading surface is situated at least at the height of the loading surface of the head piece, in order to define with the loading surface of the head piece a continuous wagon loading surface.

2. The goods wagon as claimed in claim 1, wherein on the basin for the connection with at least one loading position fastening element of the loading position fastening elements, at least one connecting element formed with a connecting opening is provided, which via the connecting opening is fixed on the at least one loading position fastening element in a positive-locking manner when the basin is present in the loading position.

3. The goods wagon as claimed in claim 1, wherein the basin in the loading position is mounted on the loading position fastening elements of the side members.

4. The goods wagon as claimed in claim 1, wherein the function position fastening elements provided on the side members, also predefine the transport position on the goods wagon for the containerized good, in which the containerized good with the basin present in the loading position, extends above the basin loading surface over at least one part of the basin loading surface.

5. The goods wagon as claimed in claim 4, wherein by way of the function position fastening elements, at least two different transport positions are predefined for the containerized good, in which the containerized good extends above the basin loading surface over at least one part of the basin loading surface.

6. The goods wagon as claimed in claim 4, wherein at least one of the function position fastening elements for the containerized good is at least one of adjustably mounted alongside a side member and completely removable from the side member.

7. The goods wagon as claimed in claim 4, wherein at least one function position fastening element of the function position fastening elements for the containerized good is pivotably mounted on one of the two side members.

8. The goods wagon as claimed in claim 7, wherein the at least one function position fastening element pivotably mounted on the side member is pivotable between a non-usage position and a usage position, and wherein the at least one function position fastening element in its non-usage position is present outside the pocket and in its usage position is present within the pocket.

9. The goods wagon as claimed in claim 1, wherein by means of the goods wagon equipped with the basin optionally one of the following containerized goods is transportable:

at least one 20 foot container, at least one 40 foot container, at least one 45 foot container, at least one semi-trailer and at least two truck tractors.

10. A goods wagon for transporting containerized goods, the goods wagon comprising:

a head piece at a front end of the goods wagon;

an end piece at a rear end of the goods wagon; and two side members extending between the head piece and the end piece, wherein a basin for goods is provided, which defines a basin loading surface, and the side members define a pocket into which the basin is inserted, the basin is configured to be mounted in both a loading position and a function position to be used for different loading scenarios on the side members, fastening elements for the basin are provided, which predefine the loading position in the pocket of the goods wagon for the basin in which the basin loading surface is situated lower than a loading surface provided on the head piece and is situated lower than a loading surface provided on the end piece, and the goods wagon is provided for transporting a containerized good independently of the basin in that a transport position is predefined on the goods wagon for the containerized good, in which the containerized good, with the basin present in the loading position, extends above the basin loading surface over at least one part of the basin loading surface so that the goods wagon is capable of transporting the containerized good without the containerized good being supported or resting on the basin loading surface.

* * * * *